US010765920B2

(12) United States Patent
Sander

(10) Patent No.: US 10,765,920 B2
(45) Date of Patent: Sep. 8, 2020

(54) IRON-TYPE GOLF CLUBS AND GOLF CLUB HEADS

(71) Applicant: KARSTEN MANUFACTURING CORPORATION, Phoenix, AZ (US)

(72) Inventor: Raymond J. Sander, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/034,256

(22) Filed: Jul. 12, 2018

(65) Prior Publication Data

US 2018/0318663 A1 Nov. 8, 2018

Related U.S. Application Data

(63) Continuation of application No. 15/453,021, filed on Mar. 8, 2017, now abandoned, which is a continuation of application No. 14/724,024, filed on May 28, 2015, now Pat. No. 9,630,074.

(51) Int. Cl.
*A63B 53/04* (2015.01)
*A63B 53/08* (2015.01)

(52) U.S. Cl.
CPC ..... *A63B 53/047* (2013.01); *A63B 53/08* (2013.01); *A63B 2053/0416* (2013.01); *A63B 2053/0454* (2013.01); *A63B 2053/0458* (2013.01); *A63B 2053/0491* (2013.01)

(58) Field of Classification Search
CPC ..... A63B 53/047; A63B 53/08; A63B 2053/0458; A63B 2053/0454; A63B 2053/0416; A63B 2053/0491; A63B 2053/042; A63B 2053/0425; A63B 2053/0429
See application file for complete search history.

(56) References Cited

U.S. PATENT DOCUMENTS

| | | | | |
|---|---|---|---|---|
| 5,354,059 | A * | 10/1994 | Stuff | A63B 53/04 473/329 |
| 5,405,137 | A | 4/1995 | Benoit | |
| 5,492,327 | A * | 2/1996 | Biafore, Jr. | A63B 53/04 473/332 |
| 6,042,486 | A * | 3/2000 | Gallagher | A63B 53/0475 473/329 |
| 7,611,423 | B2 | 11/2009 | Matsunaga et al. | |
| 8,092,318 | B2 | 1/2012 | Oldknow et al. | |
| 8,449,406 | B1 | 5/2013 | Frame | |
| 9,072,948 | B2 | 7/2015 | Franklin et al. | |
| 9,630,073 | B2 * | 4/2017 | Sander | A63B 53/047 |
| 9,630,074 | B2 | 4/2017 | Sander | |
| 2003/0032499 | A1 | 2/2003 | Wahl et al. | |
| 2005/0192116 | A1 | 9/2005 | Imamoto | |

(Continued)

FOREIGN PATENT DOCUMENTS

WO 2005007249 A2 1/2005

OTHER PUBLICATIONS

Sep. 29, 2016—(WO) International Search Report and Written Opinion—App PCT/US2016/033025.

*Primary Examiner* — John E Simms, Jr.

(57) ABSTRACT

An iron-type golf club head includes a ball striking face and a rear weight member that are engaged through one or more resilient members with a connection structure that creates a mass-damping effect at impact with a golf ball.

15 Claims, 20 Drawing Sheets

(56) References Cited

U.S. PATENT DOCUMENTS

| | | | | |
|---|---|---|---|---|
| 2006/0154746 | A1 | 7/2006 | Hagood et al. | |
| 2006/0172816 | A1 | 8/2006 | Johnson | |
| 2007/0042835 | A1* | 2/2007 | Best | A63B 53/04 473/340 |
| 2007/0129165 | A1 | 6/2007 | Matsunaga et al. | |
| 2008/0004132 | A1 | 1/2008 | Lin et al. | |
| 2008/0085781 | A1 | 4/2008 | Iwahori | |
| 2008/0234066 | A1 | 9/2008 | Jones | |
| 2009/0131198 | A1* | 5/2009 | Wallans | A63B 53/047 473/332 |
| 2009/0239681 | A1* | 9/2009 | Sugimoto | A63B 53/047 473/350 |
| 2010/0056297 | A1* | 3/2010 | Roach | A63B 53/047 473/332 |
| 2011/0021283 | A1* | 1/2011 | Hatton | A63B 53/047 473/291 |
| 2011/0034270 | A1 | 2/2011 | Wahl | |
| 2011/0086722 | A1* | 4/2011 | Oldknow | A63B 53/04 473/290 |
| 2012/0108357 | A1 | 5/2012 | Nakamura | |
| 2012/0157224 | A1 | 6/2012 | Finn | |
| 2013/0137533 | A1* | 5/2013 | Franklin | A63B 60/00 473/349 |
| 2013/0281227 | A1* | 10/2013 | Roach | A63B 53/0475 473/332 |
| 2014/0274454 | A1* | 9/2014 | Snyder | A63B 53/047 473/332 |

* cited by examiner

IRON-TYPE GOLF CLUBS AND GOLF CLUB HEADS

RELATED APPLICATION DATA

This is a continuation of U.S. patent application Ser. No. 15/453,021, filed Mar. 8, 2017, which is a continuation of U.S. patent application Ser. No. 14/724,024, filed May 28, 2015, now U.S. Pat. No. 9,630,074, issued Apr. 25, 2017, the contents of all of the above are incorporated herein in their entirety.

FIELD OF THE INVENTION

This invention relates generally to golf clubs and golf club heads, and more particularly to iron-type golf clubs and golf club heads.

BACKGROUND

Golf clubs are well known in the art for use in the game of golf. Iron-type golf clubs generally have a cavity-back configuration, a muscle-back configuration, or a blade-type configuration. Amateur golfers generally prefer cavity-back, perimeter-weighted clubs because they tend to produce better shots when not struck near the center of the face. Blade-type irons generally are preferred by professional golfers and golfers of higher skill levels because they provide better feel when a golf ball is struck in the center of the face and more feedback when not struck on the center of the face. Blade-type irons also permit golfers to more readily shape shots by adding different types of spin to the ball, whereas cavity-back irons reduce or minimize the ability to shape shots.

Cavity-back iron-type club heads, also known as "perimeter weighted" irons, are known to have a concentration of mass about the periphery of a rear surface of the club head. This concentration of mass typically is in a raised, rib-like, perimeter weighting element that projects rearwardly from the club face perimeter and substantially surrounds a rear cavity, which comprises a major portion of the rear surface of the club head. In addition to locating a substantial amount of mass away from the center of the club head behind the club face, the rib-like perimeter weighting element acts as a structural stiffener, which compensates for a reduction in face thickness in the cavity region.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

According to aspects of this invention, an iron-type golf club head may comprise a ball striking face and a rear weight member that are engaged at least partially through one or more resilient members with a connection or engagement structure that creates a mass-damping effect at ball impact.

As some more specific examples, aspects of this invention relate to iron-type golf club heads that include: (a) a ball striking face member comprising a first material having a first hardness, wherein the face member includes a rear surface; (b) a rear weight member comprising a second material having a second hardness, wherein the weight member has a front surface, wherein the front surface of the weight member and the rear surface of the face member generally oppose one another and define a space therebetween; (c) at least one resilient member comprising a third material having a third hardness; and (d) at least one engagement member disposed within the space and optionally contacting at least one of the front and rear surfaces. These golf club heads may include one or more of the following properties and/or features in any desired numbers and/or combinations: (a) the third hardness may be less than the first and/or second hardnesses such that the at least one resilient member exhibits substantially greater compressibility than does the face member and the rear weight member; (b) the at least one engagement member may define at least three separated support regions within the space that limit compressibility between the face member and the weight member, the at least three separated support regions dividing the space into an area of low compressibility and an area of high compressibility, wherein the area of high compressibility has a greater compressibility than the area of low compressibility; and (c) the resilient member may be disposed between the weight member and the face member and located at least in the area of high compressibility (and optionally all around the at least one engagement member.

As some additional potential features, the engagement member(s) may include one or more of the following properties or features: at least one may be rigidly connected to the face member; at least one may be rigidly connected to the weight member; at least one may be formed integrally with and of the same material as the face member; and/or at least one may be formed integrally with and of the same material as the weight member. In some examples, the engagement member may be engaged with the resilient member.

Additionally or alternatively, if desired, the weight member may comprise one or more weight components that are captive within the resilient member. As some more specific examples, if desired, the weight component(s) may include one or more parts (e.g., made of tungsten, lead, tungsten-containing, or lead-containing materials, etc.) that are embedded in the third material of the resilient member, fit into chambers or recesses formed in the resilient member (and optionally secured therein with an adhesive, mechanical connector, etc.), and the like.

The resilient member may contact and/or be attached to one or both of the front surface of the weight member and/or the rear surface of the face member. Optionally, the resilient member may constitute two or more separate resilient member components. When two or more resilient member components are present, each resilient member component may contact and/or be attached to the front surface of the weight member and/or the rear surface of the face member.

The at least one engagement member may constitute at least three, four, or even more connection point supports, each connection point support providing a respective one of the at least three, four, or even more separated support regions. The three or more connection point supports may be arranged in a linear arrangement, a triangular arrangement, a square or rectangular arrangement, in another polygonal arrangement, and/or in any other desired arrangement. In some example structures, the golf club head face member may include a scoreline or groove on its front surface, and at least three of the separated support regions may be arranged substantially in a straight line that is substantially parallel to the scoreline/groove.

In accordance with at least some examples of this invention, an elastic modulus of the third material of the resilient member(s) will be less than an elastic modulus of one or more of (and optionally each of) the first material (of the ball striking face member) and the second material (of the rear weight member), and less than elastic moduli of materials making up the three or more connection point supports. In some examples, the elastic modulus of the materials making up the three or more connection point supports will be at least 500 times the elastic modulus of the third material. Additionally or alternatively, the third material may be more compressible than the at least three separated support regions.

As another example, iron-type golf club heads in accordance with some examples of this invention may include: (a) a ball striking face member comprising a first material having a first hardness, wherein the face member includes a rear surface; (b) a rear weight member comprising a second material having a second hardness, wherein the weight member has a front surface, and wherein the front and rear surfaces generally oppose one another and have a space therebetween; (c) at least one resilient member comprising a third material having a third hardness; and (d) at least one engagement member disposed within the space and optionally contacting at least one of the front and rear surfaces. These golf club heads may include one or more of the following properties and/or features in any desired numbers and/or combinations: (a) the third hardness may be less than the first and second hardnesses such that the at least one resilient member exhibits substantially greater compressibility than does the face member and the rear weight member; (b) the at least one engagement member may define at least two separated support regions within the space that limit compressibility between the face member and the weight member, the at least two separated support regions dividing the space into an area of low compressibility and an area of high compressibility, wherein the area of high compressibility has a greater compressibility than the area of low compressibility; and (c) the resilient member may be disposed between the weight member and the face member and located at least in the area of high compressibility.

In this example, the at least one engagement member may constitute two (or more) connection point supports, each connection point support providing a respective one of the at least two separated support regions. An elastic modulus of the third material of the resilient member may be less than an elastic modulus of each of the first and second materials (of the face member and the rear weight member, respectively), the elastic modulus of the third material may be less than elastic moduli of materials making up the two connection point supports, and/or the third material may be more compressible than the at least two separated support regions.

Structures in accordance with this aspect of the invention also may include any of the various features, options, or variations described above for the face member, rear weight member, the engagement member, and/or the resilient member. As one more specific example, if desired, the face member of this example golf club head may include a scoreline or groove thereon, and the at least two separated support regions may be arranged along a line that is substantially parallel to the scoreline/groove.

BRIEF DESCRIPTION OF THE DRAWINGS

A more complete understanding of the present invention and certain advantages thereof may be acquired by referring to the following detailed description in consideration with the accompanying drawings, in which.

Figure 1A:
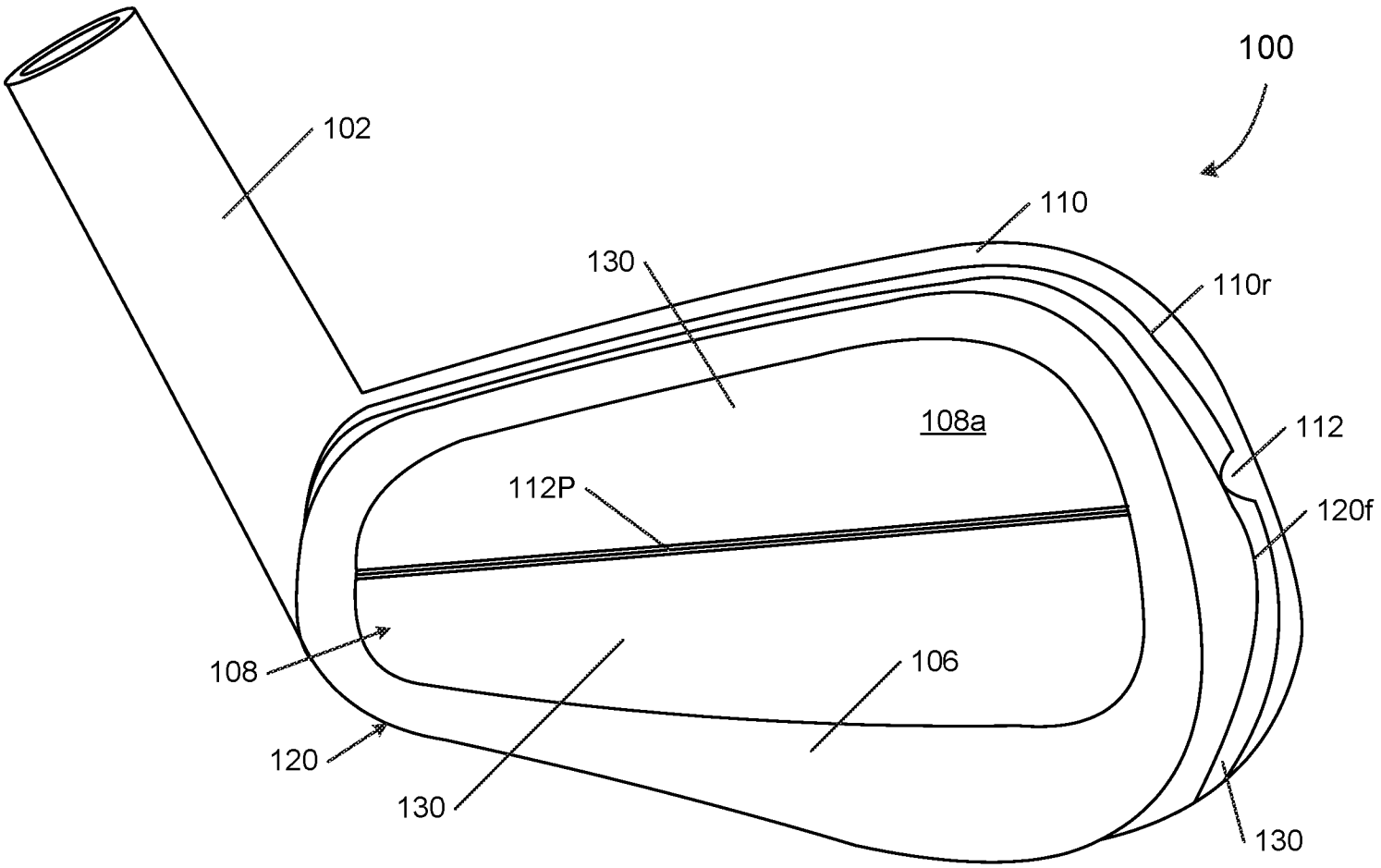
FIG. 1A illustrates a rear perspective view of an example golf club head according to some examples of this invention.
Figure 1B:
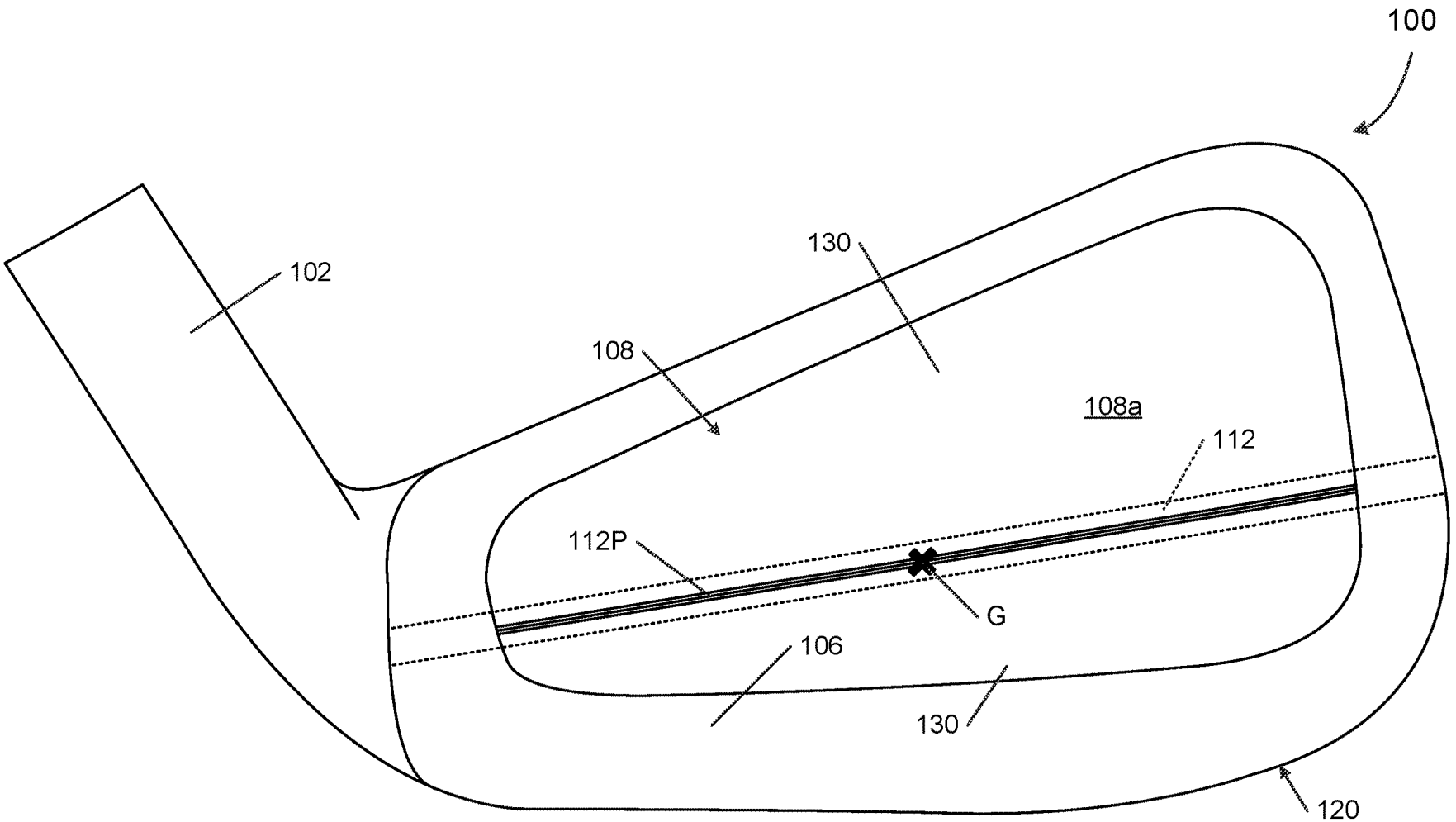
FIG. 1B illustrates a rear view of an example golf club head according to some examples of this invention.
Figure 1D:
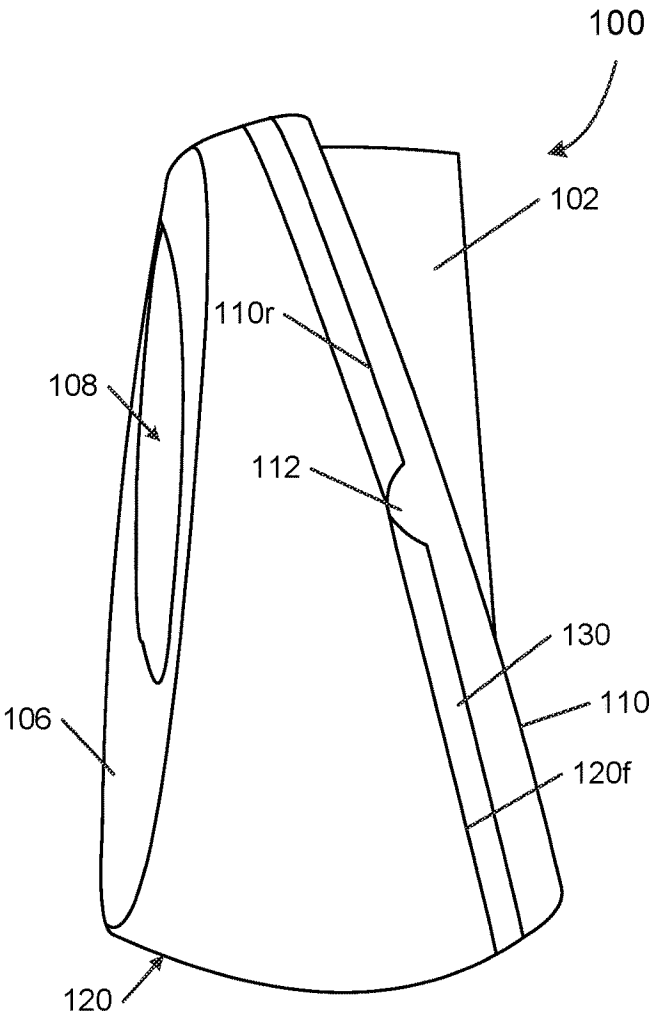
FIG. 1D illustrates a toe side view of an example golf club head according to some examples of this invention.
Figure 1C:
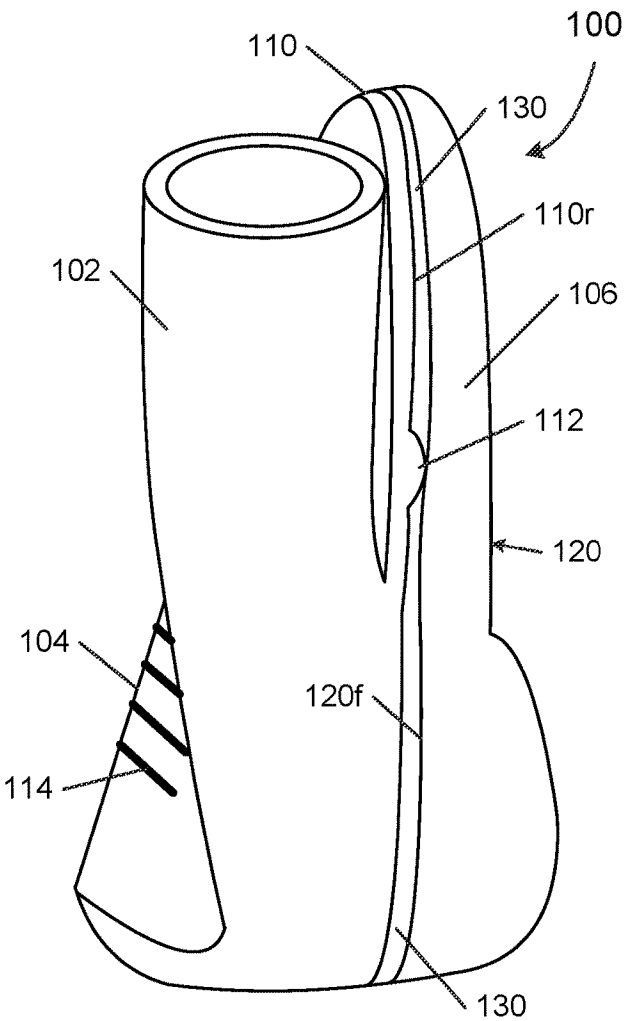
FIG. 1C illustrates a heel side view of an example golf club head according to some examples of this invention.
Figure 1E:
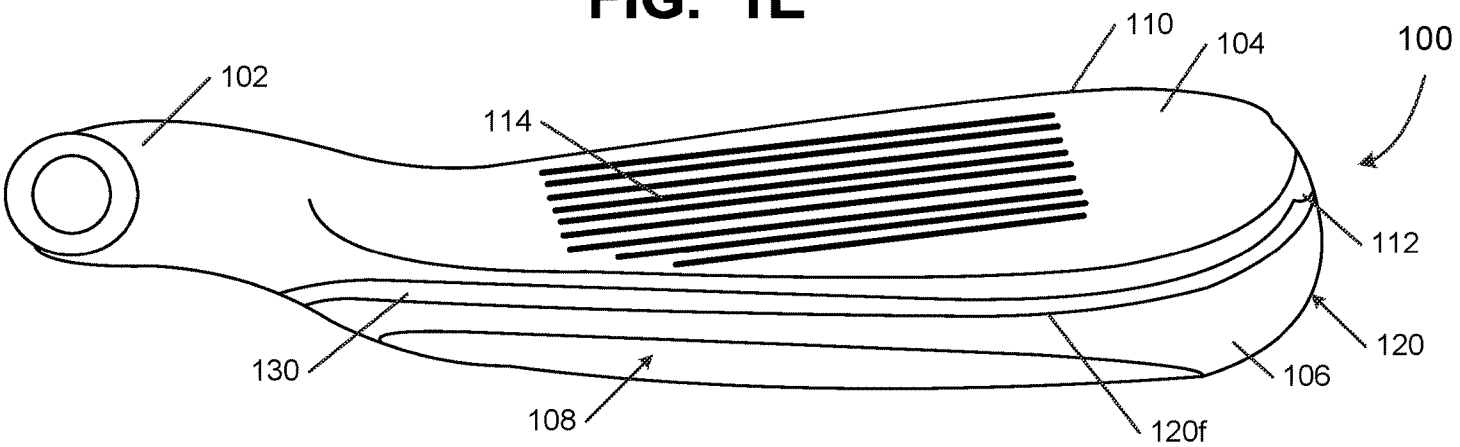
FIG. 1E illustrates a top view of an example golf club head according to some examples of this invention.
Figure 1F:
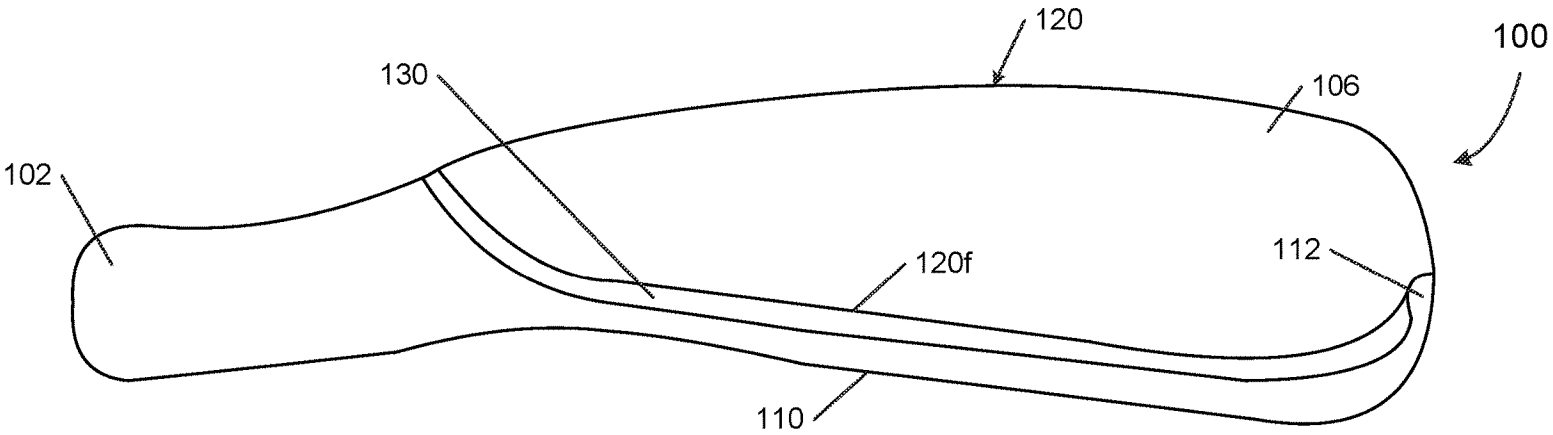
FIG. 1F illustrates a bottom view of an example golf club head according to some examples of this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads, golf club head parts, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use (e.g., orientation at address, orientation at a "standard" orientation position (e.g., a club head orientation at which measurements for determining compliance with USGA Rules are made)). Nothing in this specification should be construed as requiring a specific three dimensional or spatial orientation of structures in order to fall within the scope of this invention.

FIGS. 1A through 1G provide various views of a first example iron-type golf club head 100. This example club head 100 includes a hosel member 102 (e.g., for engaging a shaft), a ball striking face 104, and a rear perimeter weight 106 (which at least in part defines a rear cavity area 108 (or "cavity back" construction) in the club head structure 100). The ball striking face 104 constitutes the front surface of a ball striking face member 110, which may have a flat plate structure or other desired structure (e.g., a flat ball striking face plate that extends at the heel side of the club head 100 to form the hosel 102 or a portion of the hosel 102, etc.). The ball striking face member 110 may be made of any desired material or materials, including steel, stainless steel, titanium, and/or other metal or metal alloy materials and/or materials conventionally known and used in golf club iron construction. Also, the ball striking face member 110 may be made from one part or two or more component parts that are engaged together (e.g., by welding or other fusing techniques, by adhesives or cements, by one or more mechanical connectors (e.g., screws, bolts, etc.), or the like). The ball striking face member 110 may be formed by forging, casting, stamping, and/or in other manners, including in manners conventionally known and used in the golf club arts.

As shown in FIGS. 1A-1G, in this illustrated example, a raised rib element 112 extends rearward from the rear surface 110*r* of the ball striking face member 110 (extending rearward from the major surface 110*r* opposite ball striking surface 104). This raised rib element 112 may be integrally formed as part of the ball striking face member 110 when the ball striking face member 110 is formed (e.g., by casting, forging, stamping, etc.), or it may be a separate part engaged with the rear surface 110*r* of the ball striking face member 110 in a separate step (e.g., by welding or other fusing techniques, by adhesives or cements, by one or more mechanical connectors (e.g., screws, bolts, etc.), or the like). In this illustrated example, the raised rib element 112 projects rearward from rear surface 110*r* of the ball striking face member 110 in a half-cylinder shape, e.g., with a half circle cross section. Other raised rib element 112 shapes may be utilized, as will be described in more detail below.

This example club head structure 100 further includes a rear weight element 120 as a separate part provided at the rear of the club head structure 100. The rear weight element 120 provides a rear surface behind the ball striking face member 110 and includes a large ring member that forms the perimeter weight 106. In some examples, surface 108*a* inside the perimeter weight 106 structure of the rear weight element 120 may constitute a part of the rear weight element 120 (e.g., an exposed surface of a thin plate that constitutes a front wall part of rear weight element 120 such that the cavity 108 does not extend completely through the rear weight element 120). In other examples, however, surface 108*a* may constitute an exposed surface of another part of the club head structure 100 (e.g., such that rear weight element 120 contains a through hole at the cavity 108 inside the perimeter weight 106). As another option, if desired, a portion of the cavity 108 in the rear weight element 120 may provide a through hole while another portion of the cavity 108 may be closed off by a part of rear weight element 120. The rear weight element 120 may be made of any desired material or materials, including steel, stainless steel, titanium, or other metal or metal alloy materials; polymer materials; fiber-reinforced polymer materials; and/or materials conventionally known and used in golf club iron construction. The rear weight element 120 also may contain lead, tungsten, and/or other dense materials to increase the weight of element 120. Also, the rear weight element 120 may be made from one part or two or more component parts that are engaged together (e.g., by welding or other fusing techniques, by adhesives or cements, by one or more mechanical connectors (e.g., screws, bolts, etc.), or the like).

FIGS. 1A-1G further illustrate one or more resilient members 130 provided between the ball striking face member 110 and the rear weight element 120. The resilient member(s) 130 may be made, for example, from a natural or synthetic rubber material; a polyurethane-based elastomer; a silicone material; and/or one or more other elastomeric material(s), but the member(s) 130 also may be made of different types of resilient materials, including various types of resilient polymers, such as foam materials or other rubber-like materials. In some more specific examples, the resilient member(s) 130 may be a thermoplastic (TPE) vulcanizate. Additionally, the resilient member(s) 130 may have resiliency, such that the resilient member(s) 130 compresses in response to an applied force and returns to its previous (uncompressed) state when the force is removed or sufficiently relaxed. Resilient member(s) 130 also may have viscoelasticity such that some energy loss (and thus mass-damping effect) is associated with the return to the uncompressed state. The resilient member(s) 130 may have a strength or hardness that is lower than, and may be significantly lower than, the strength/hardness of the material of the face member 110 and/or the rear weight member 120. In some examples, the resilient member(s) 130 may have a hardness of from about 70 Shore A to about 70 Shore D. The hardness may be determined, for example, by using ASTM D-2240 or another applicable test with a Shore durometer.

In the illustrated example of FIGS. 1A-1G, the rear weight member 120 is configured to receive transferred energy and/or momentum from impact between the face member 110 and a golf ball, e.g. on the ball striking face 104, and to selectively compress resilient member 130. The rear weight member 120 may be at least partially made from a material that is heavier and/or more dense than the material(s) of the face member 110, and the rear weight member 120 may make up about 30-90% of a total weight of the head 100 (and in some examples, from about 40% to about 75% of a total weight of the head 100). The rear weight member 120 may be connected to the face member 110 in a number of different configurations and/or orientations that permit this selective compression of resilient member 130 between the rear weight member 120 and the face member 110. Several such configurations are described below and shown in the figures.

More specifically, the rear weight member 120 in this example structure 100 is engaged with the face member 110 such that the raised rib element 112 of the face member 110 supports or engages (directly or indirectly) the rear weight member 120 (e.g., a front surface at the perimeter weight 106). Thus, the raised rib element 112 faces rearward and faces the rear weight member 120 as shown in FIGS. 1A-1G. The various parts of the club head 100 may be engaged together such that raised rib element 112 rigidly engages both the face member 110 and the rear weight member 120 to form a point or line of engagement between these components. At this point or line of engagement, less compression will occur at impact than in the surrounding or nearby resilient material of resilient member 130. Contact between the face member 110 and the rear weight member 120 along the raised rib 112 may be the only direct point or line of contact between the face member 110 and the rear weight member 120 around at least the face perimeter and/or in the overall club head structure 100. Resilient member(s) 130 may isolate the face member 110 from the rear weight member 120 (and may generally lie between the rear surface 110*r* of the face member 110 and the front surface 120*f* of the weight member 120).

Engagement between the face member 110 and the rear weight member 120 along raised rib 112 (e.g., at least at the perimeter weight areas 106) may be configured and oriented to form a point or line of relatively low compression that permits more efficient impact energy distribution from the face member to the weight member when a ball is struck at that point along the line. For example, in the structure shown in FIGS. 1A-1G, the raised rib 112 forms one or more lines of rigid engagement (e.g., a line segment at each of the heel and toe sides of the perimeter weight area 106) between the face member 110 and the rear weight member 120. These line segments of rigid engagement extend along one or more lines extending in the heel-to-toe direction of the club head 100, with the resilient member(s) 130 separating the face member 110 from the rear weight member 120 at least above and below the line or line segments of contact at the raised rib 112. The term "rigid engagement" as used herein in this context does not necessarily imply any fixing or attachment, but instead, means that the surfaces engaging each other are more rigid, or less flexible and/or compressible, and thus behave rigidly during a ball strike and/or energy and/or momentum transfer. For example, the raised rib 112 illustrated in FIGS. 1A-1G may rigidly engage the face member 110 with the rear weight member 120 through non-fixed abutment (and each of face member 110 and/or rear weight member 120 may be fixedly engaged with the resilient member 130, e.g., using cements or adhesives, other fusing techniques, mechanical connectors, etc.). In this manner, at areas above and below the raised rib 112, the face member 110 may be considered "compressibly coupled" to the rear weight member 120 via their less rigid connection via resilient member(s) 130.

Figure 1H:
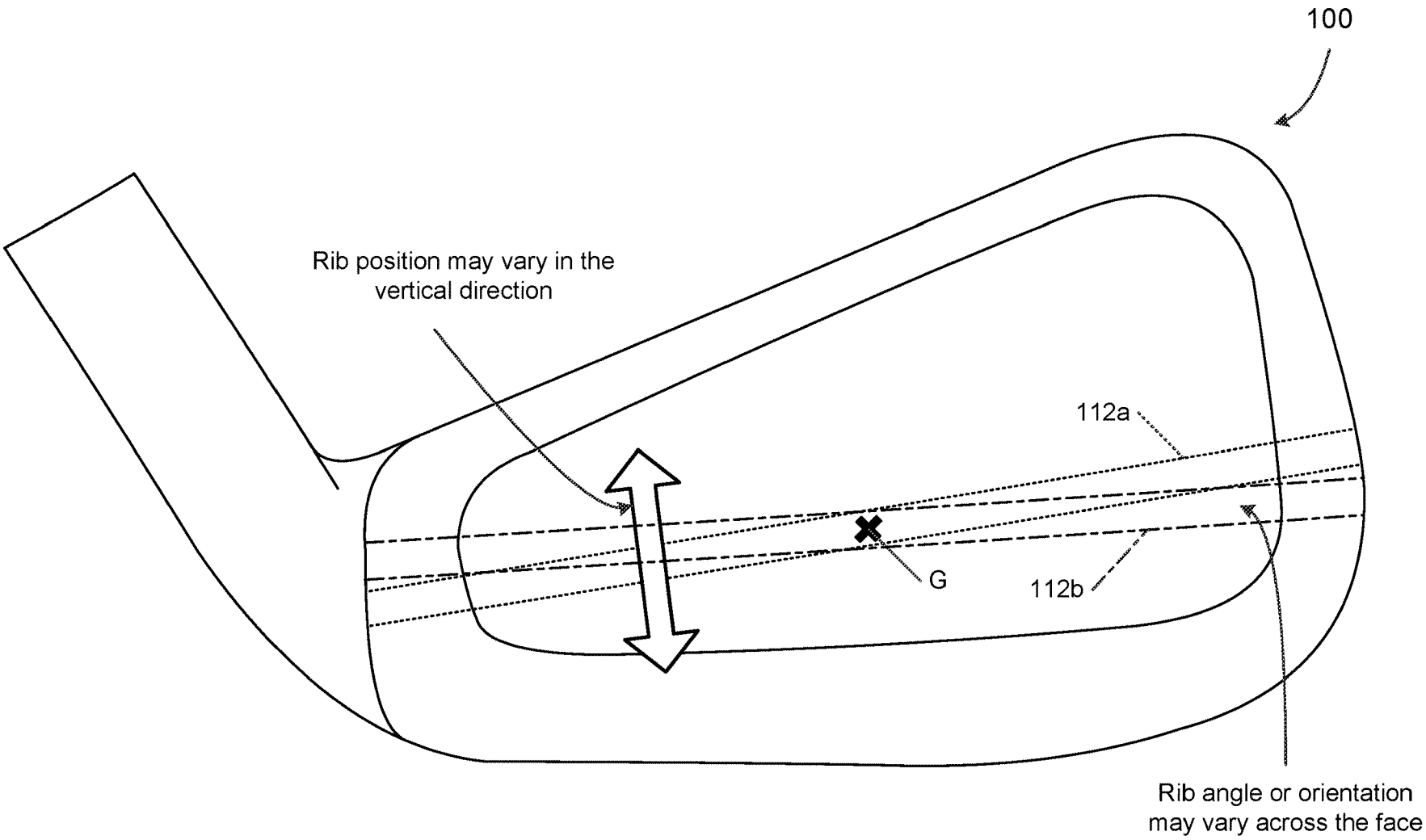
FIGS. 1H and 1I illustrate rear views of golf club heads according to some examples of this invention with various options or features highlighted.

Although other positions and/or orientations are possible, the raised rib 112 may be positioned and oriented so that it extends along a line generally parallel to one or more groove lines 114 formed on the ball striking face 104 of the club head 100. Groove lines 114 may be conventional grooves as known and used in the art, including grooves that comply with USGA and/or R&A Rules of Golf requirements. Also, while the vertical location of the raised rib 112 with respect to the club head 100 may vary, in some examples of this invention, the raised rib 112 will be located such that the rearward peak 112P of the raised rib 112 is located on a line extending perpendicularly rearward from the ball striking face 104 through the club head's center of gravity (e.g., point Gin FIGS. 1B and 1G). In a set of golf clubs including this type of raised rib element 112 and resilient member 130 engagement between a face member 110 and a rear weight member 120, the location and/or orientation of the raised rib element 112 may differ from club to club over the set of irons (e.g., located vertically higher on some irons as compared with other irons). Examples of potential variations in location and/or orientation of the raised rib 112 in the vertical direction are shown by the arrow in FIG. 1H, and examples of potential variations in location and/or orientation in the angular direction are shown by comparing the broken line pair 112*a* and the dot/dash line pair 112*b* in FIG. 1H. Other location, angular variations, and curved variations also are possible, such as the curvilinear raised rib orientations shown by the broken line pair 112*c* and the dot/dash line pair 112*d* in FIG. 1I. Many variations in the curved raised rib 112*c*, 112*d* may be utilized without departing from this invention, including variations in: the height or depth of the curve apex, the toe-to-heel location of the curve apex, the number of curve apexes, the orientation of the curved rib 112*c*, 112*d* with respect to the face location, etc. The ribs or other engagement members provide lines (straight or curved) of reduced compressibility in the club head (as area around the engagement member(s) 112 is less compressible than resilient member(s) 130 and/or areas away from the engagement member(s) 112).

In the illustrated example of FIGS. 1A-1G, two resilient members 130 are provided, one above the peak 112P of the raised rib element 112 and one below the peak 112P. In this manner, the peak 112P (and optionally more of the raised rib) may be visible in the rear cavity 108 of the club head 100. Note FIGS. 1A and 1B (the overall location of the raised rib 112 is shown in broken lines in FIG. 1B, as at least some of the rib element 112 may be covered by the resilient member(s) 130). Other options are possible, as will be described in more detail below.

As noted above, the resilient member(s) 130 may be made of a material having at least some degree of resiliency, such that the resilient member 130 compresses in response to the force a ball strike and can return to its previous (uncompressed) state following compression. With the resilient member(s) 130 interposed between the face member 110 and the rear weight member 120 at least above and below the raised rib element 112, energy and/or momentum can be transferred between the rear weight member 120 and the face member 110 during ball impact, particularly when the ball strikes the face 104 at an "off-center" location above or below the rib element 112. Additionally, the rear weight member 120 also may be configured to resist deflection of the face member 110 upon impact of the ball on the striking face 104. The resilient member 130 may compress and return to its uncompressed, or beyond its uncompressed state, repeatedly after contact between the face member 110 and a ball. Each compression-decompression cycle will be generally smaller than a previous cycle, if applicable, as a result of hysteresis losses within the resilient material, resulting in a mass-damping effect.

More specifically, on an off-center ball strike (e.g., when the ball strikes the face 104 above or below the vertical location of the raised rib element 112), contact between the ball and the face member 110 will apply a compressive force on the resilient member 130 at the location of contact below the raised rib element 112. Because the rear weight member 120 and the face member 110 are not directly engaged together at that vertical location (but rather, the resilient member 130 lies between these components), compression of the resilient member 130 absorbs some of the energy of the ball strike while the rear weight member 120 maintains more of its original energy and momentum from the force of the swing. This has a positive effect on the feel of the club on off-center hits, while providing more "direct" feel when the ball is struck on locations directly in front of the rib element 112.

Figures 1G, 2A, 2B:
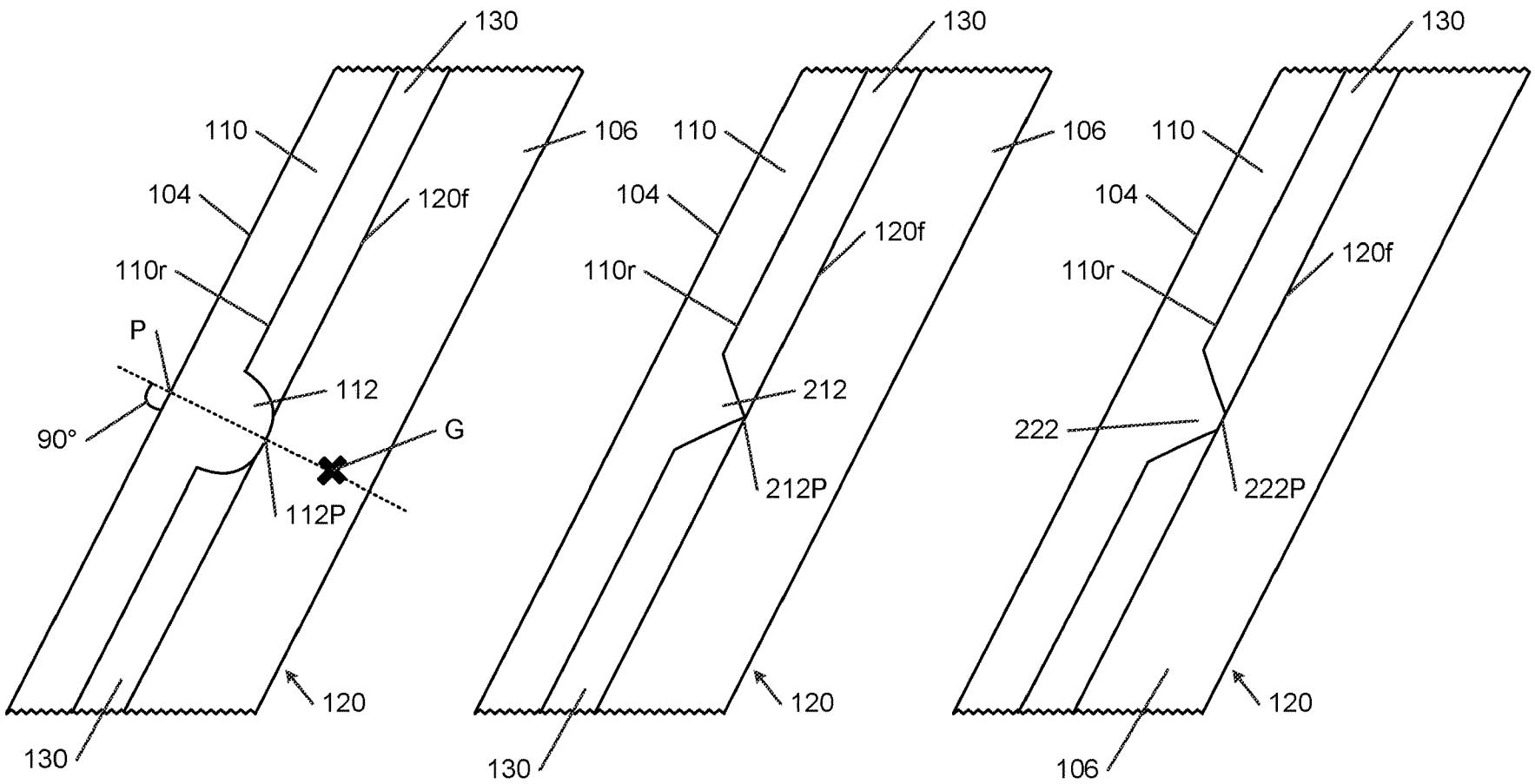
FIG. 1G illustrates an enlarged toe or heel side view of an example golf club head according to some examples of this invention in the area of a raised rib provided as part of the engagement or connection structure (this view also could correspond to a cross sectional view through a raised rib element)
FIG. 2A illustrates an enlarged toe or heel side view of an example golf club head according to some examples of this invention in the area of a raised rib provided as part of the engagement or connection structure (this view also could correspond to a cross sectional view through a raised rib element)
FIG. 2B illustrates an enlarged toe or heel side view of an example golf club head according to some examples of this invention in the area of a raised rib provided as part of the engagement or connection structure (this view also could correspond to a cross sectional view through a raised rib element)

In the example of FIGS. 1A-1G, the raised rib element 112 is in the shape of a rounded member, and the rear body member 120 directly contacts the peak 112P of the rounded portion of the rib member 112. When a ball hits the face at a location directly in line with the peak 112P (e.g., point P on face 104, as shown in FIG. 1G), the player "feels" solid contact with the ball.

Figure 1I:
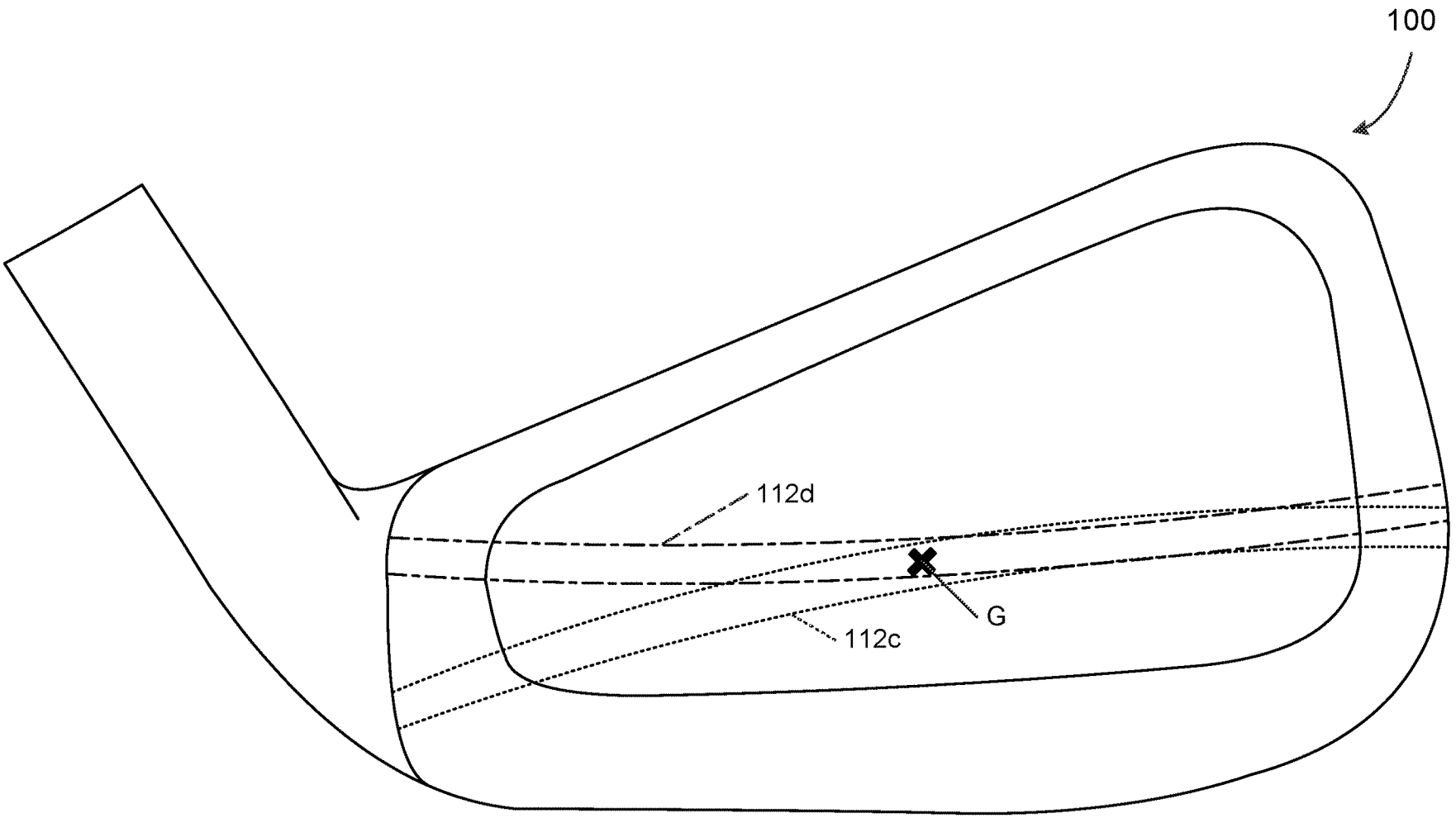

The raised rib element 112 may take on other shapes or configurations as well. For example, as shown in FIG. 2A, the raised rib element 212 in this example has a more pointed peak shape 212P (e.g., a triangular cross sectional shape) as compared to the rounded example of FIGS. 1A-1G. In the example of FIG. 2B, on the other hand, the raised rib element 222 has a peak 222P with a somewhat flattened surface (e.g., a trapezoidal cross sectional shape). As other options (as shown in FIG. 1I), if desired, the raised rib may extend in a curved or curvilinear longitudinal manner or path (rather than the straight line linear longitudinal path shown in FIGS. 1A-1G).

In the example structures shown in FIGS. 1G, 2A, and 2B, there is direct contact (rigid engagement) between the rear body member 120 and the face member 110 at the location of the raised rib elements 112, 212, 222. Optionally, if desired, each of these raised rib elements 112, 212, 222 may be at least partially exposed in the final golf club head structure 100, e.g., within the cavity 108 (if the rear body member 120 has a through hole within the cavity 108 area and the resilient member 130 does not completely cover the rib elements 112, 212, 222). Alternatively, if desired, the cavity 108 defined by the rear body member 120 may have a front wall such that the peaks 112P, 212P, 222P of the raised rib elements 112, 212, 222 are covered and directly engage the rear body member 120 (e.g., the perimeter weight portions 106 and/or the front wall of the rear body member 120) along all or substantially all of the raised rib length.

Figure 3B:
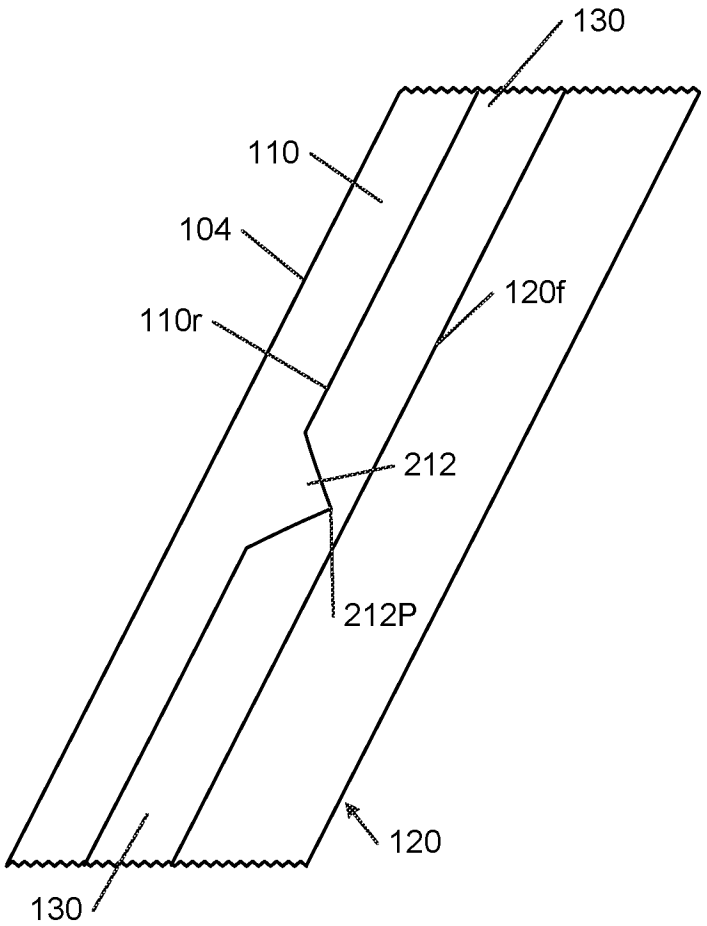
FIG. 3B illustrates an enlarged toe or heel side view of an example golf club head according to some examples of this invention in the area of a raised rib provided as part of the engagement or connection structure (this view also could correspond to a cross sectional view through a raised rib element)
Figure 3A:
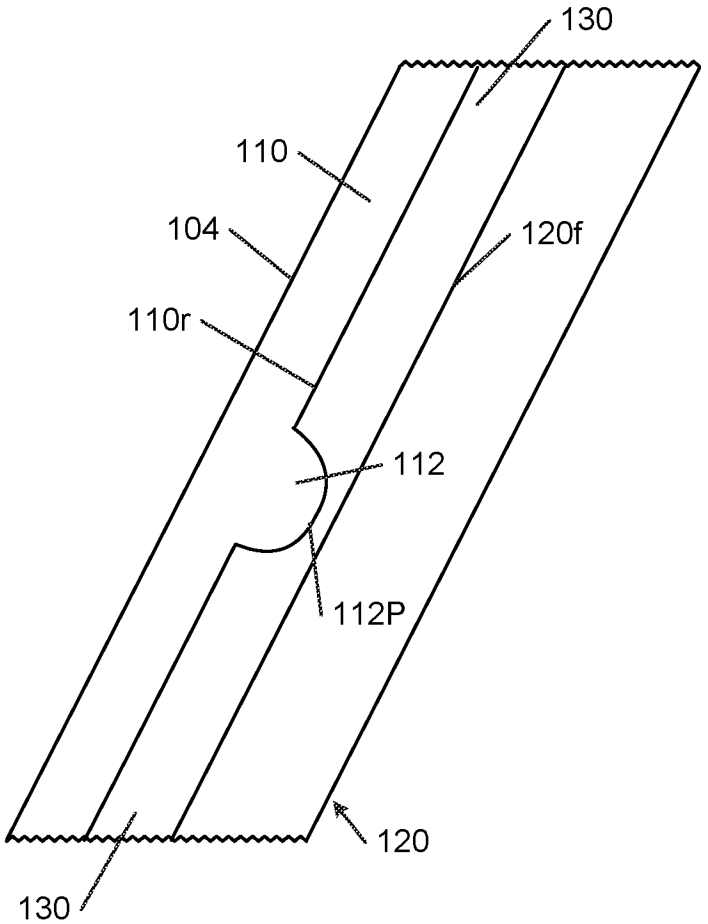
FIG. 3A illustrates an enlarged toe or heel side view of an example golf club head according to some examples of this invention in the area of a raised rib provided as part of the engagement or connection structure (this view also could correspond to a cross sectional view through a raised rib element)

Other options are possible. For example, as shown in FIGS. 3A and 3B, if desired, the resilient member 130 may be made as one or more pieces that completely cover the peaks 112P, 212P of the raised rib elements 112, 212. If desired, the thickness of the resilient member 130 between the peak 112P, 212P and the rear body member 120 will be relatively thin (e.g., less than 5 mm, and in some examples, less than 3 mm, but generally greater than about 1 mm in thickness), e.g., to fine-tune the amount of compression of resilient member 130 at impact. As another option or alternative, if desired, the hardness of the material used to form the resilient member 130 may be varied to fine-tune the amount of compression, and mass-damping, at impact for a given thickness. Further, proximate the location of and/or near the peaks 112P, 212P, the material of resilient member may be provided with a higher hardness so as to progressively vary the amount of compression of the resilient member 130 for impacts proximate the peak 112P, 212P. In another example, the material of resilient member 130 may have a hardness gradient in the direction away from rib element 112, 212 and/or peaks 112P, 212P. The same or similar resilient member 130 construction (completely covering peak 222P and rib 222) also could be used in the example structure shown in FIG. 2B.

In other club head structures, surface 108*a* within the cavity 108 may constitute the rear surface 110*r* of the face member 110. In such constructions, the resilient member(s) 130 may constitute or form a ring of material with an open central hole, wherein the ring of material lies between the perimeter weight portion 106 of the rear weight member 120 and the perimeter of the rear surface 110*r* of the ball striking face member 110.

Figures 4A, 4B, 4C:
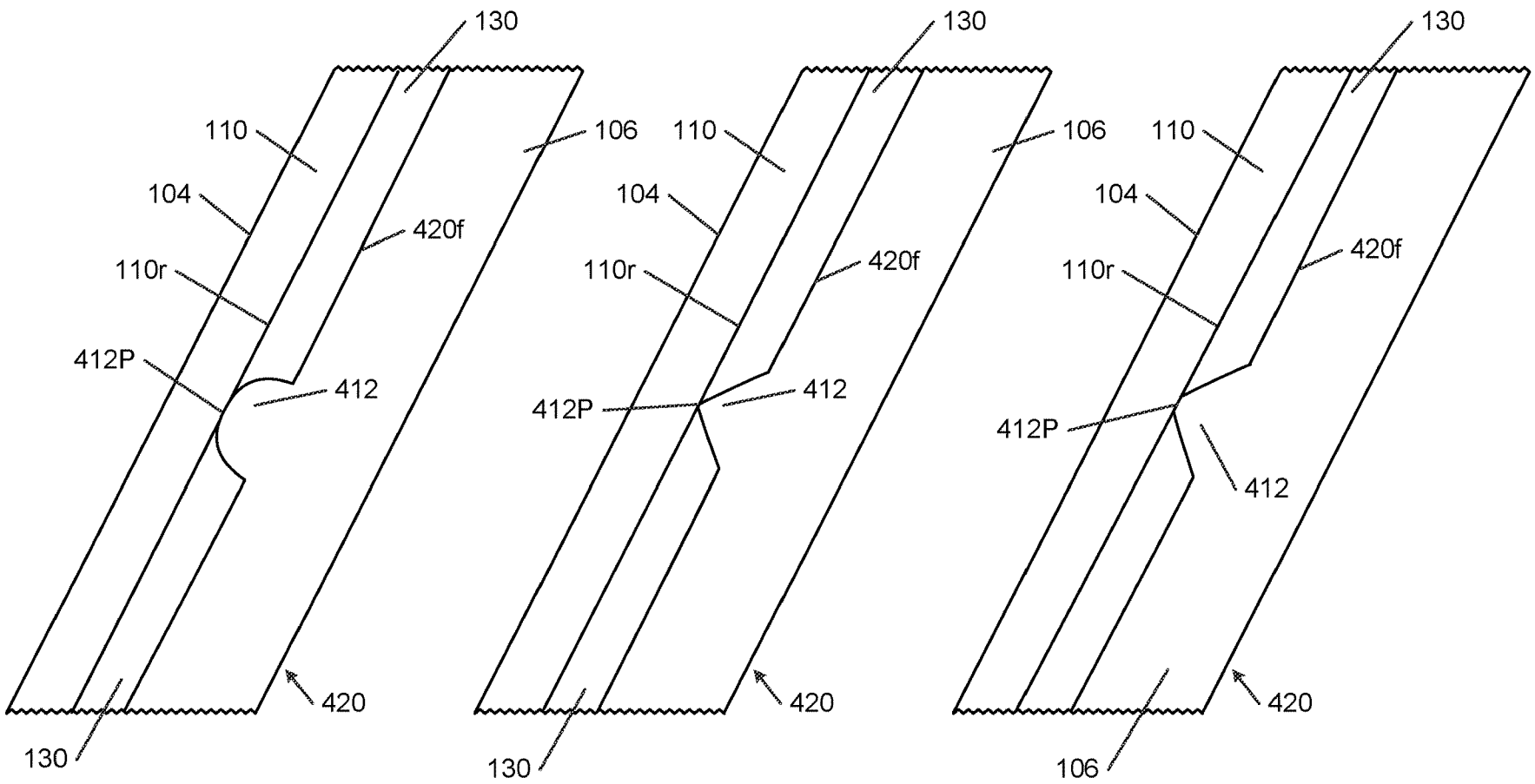
FIG. 4A illustrates an enlarged toe or heel side view of an example golf club head according to some examples of this invention in the area of a raised rib provided as part of the engagement or connection structure (this view also could correspond to a cross sectional view through a raised rib element)
FIG. 4B illustrates an enlarged toe or heel side view of an example golf club head according to some examples of this invention in the area of a raised rib provided as part of the engagement or connection structure (this view also could correspond to a cross sectional view through a raised rib element)
FIG. 4C illustrates an enlarged toe or heel side view of an example golf club head according to some examples of this invention in the area of a raised rib provided as part of the engagement or connection structure (this view also could correspond to a cross sectional view through a raised rib element)

Also, in the example structures described above, the raised rib members are provided on the rear surface 110*r* of the face member 110. This also is not a requirement. For example, as shown in FIGS. 4A-4C, in some example structures, the raised ribs 412 are provided on the forward surfaces 420*f* of the rear weight member 420. The peaks 412P of these raised ribs 412 can then engage the rear surface 110*r* of the face member 110 in a manner similar to that described above. Although not illustrated, rear weight members like 420 with raised ribs 412 and peaks 412P also could be used in structures like those shown in FIGS. 3A and 3B (wherein a thin layer of resilient member 130 is located between the peak 412P and the rear surface 110*r* of the ball striking face member 110).

While the raised rib elements (e.g., 112, 212, 222, 412) are shown as integral parts with the face member or weight member in the embodiments described above, this is not a requirement. Rather, if desired, in any of the example structures described above (and/or those described in more detail below), the raised rib elements (e.g., sharp edged ribs, rounded edged ribs, cones, etc.) may be formed as a separate part from the ball striking face member 110 and/or the weight member 120, 420, and this separate part may be engaged with the ball striking face member 110 and/or the weight member 120, 420. When formed as a separate part, the material of the raised rib separate part may be more rigid than the material of at least the resilient member 130. This separate raised rib element 112 may be engaged with the face member 110 and/or weight member 120, 420 by welding or other fusing techniques; by adhesives or cements; by one or more mechanical connectors (e.g., screws, bolts, etc.); or the like). As yet other options, the raised rib element 112 part may be engaged with the resilient member 130 (e.g., by adhesives or cements; by one or more mechanical connectors (e.g., screws, bolts, etc.); or the like). The raised rib element 112 also could be a polymer material engaged with the resilient member 130, the face member 110, and/or the weight member 120, 420, e.g., by co-molding, etc.

Figure 5:
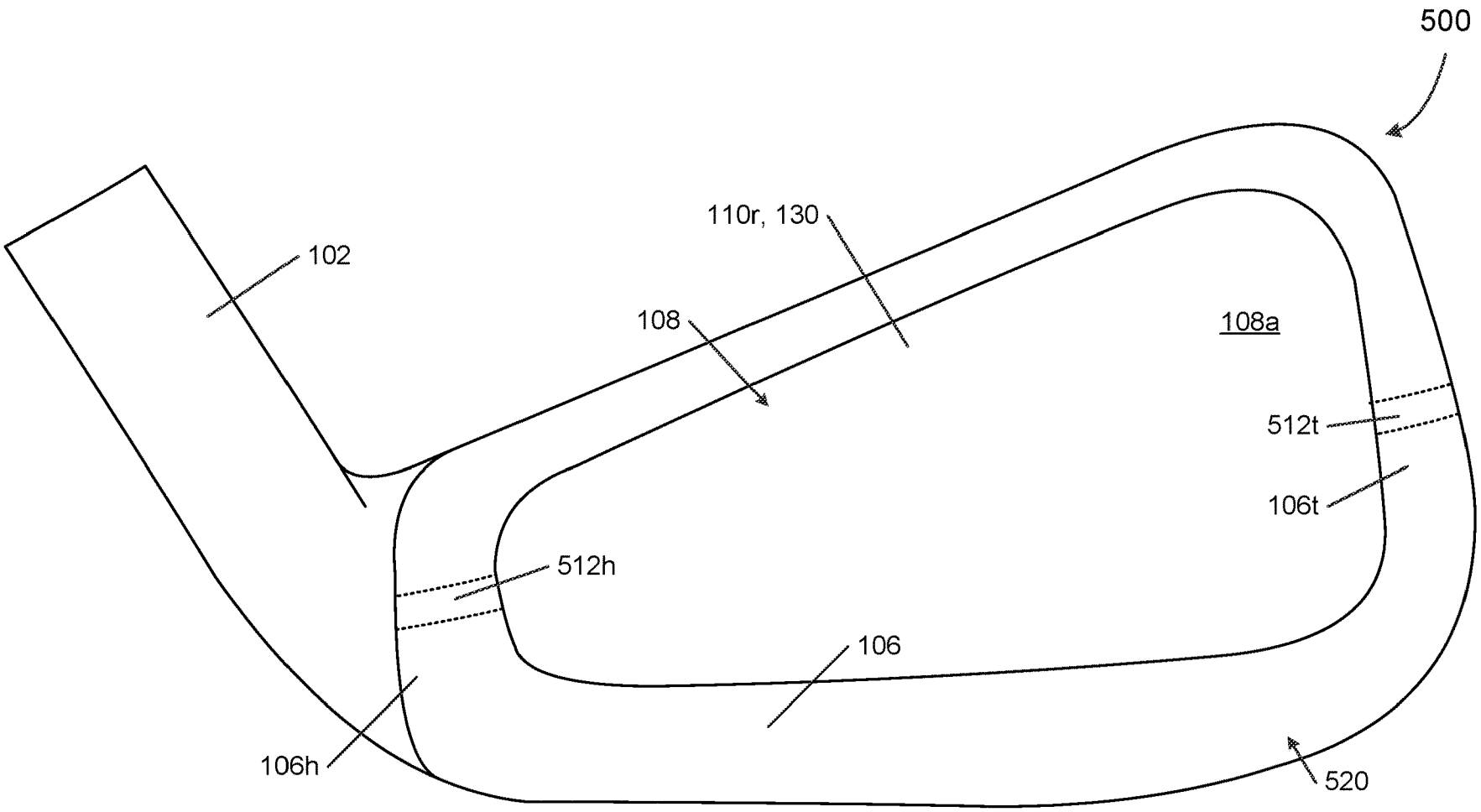
FIG. 5 illustrates a rear view of another example golf club head according to some examples of this invention.

In the example structure 100 shown in FIGS. 1A-1G, the rib member 112 is shown extending completely across the rear surface 110*r* of the ball striking face member 110, continuously from the heel edge to the toe edge of the ball striking face member 110. Other options are possible. For example, in the example golf club head structure 500 shown in FIG. 5, the rear weight member 520 is rigidly engaged to two short rib members. One short rib member 512*h* is provided at the heel side 106*h* of the perimeter weight member 106 and the other short rib member 512*t* is provided at the toe side 106*t* of the perimeter weight member 106. This type of arrangement of two short rib members (e.g., 512*h*, 512*t*) may be well suited for club head constructions in which the rear weight member 520 has a through hole in the cavity area 108 (e.g., if surface 108*a* of FIG. 5 shows a rear surface of resilient member(s) 130 and/or a rear surface 110*r* of the ball striking face 110). In this structure 500, if desired, the resilient member(s) 130 may form a ring (or two half rings) that underlies only the perimeter weight area 106 of rear weight member 520 (e.g., resilient member 130 may be in the form of a ring having a through hole, two half ring resilient members may be provided (one on top, one on the bottom), etc.).

The configuration of FIG. 5, with two short rib members 512*h* and 512*t*, also may be used in any of the constructions and/or variations described above, including in the structures and/or variations described above and/or shown in FIGS. 1A-1G, 2A, 2B, 3A, 3B, and/or 4A-4C.

Figure 6:
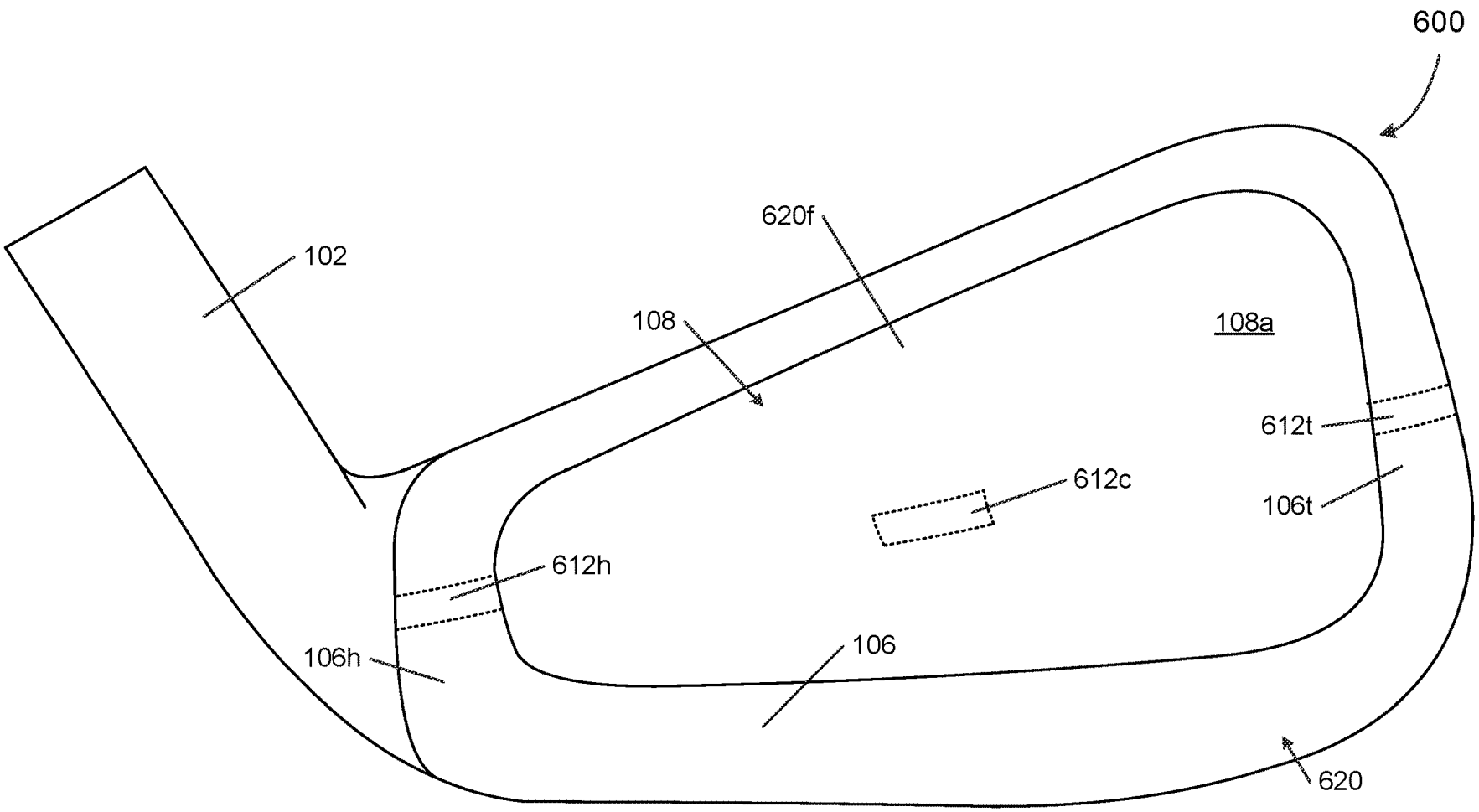
FIG. 6 illustrates a rear view of another example golf club head according to some examples of this invention.

FIG. 6 illustrates another example club head structure 600 having multiple short rib members, including a heel rib member 612*h* and a toe rib member 612*t* located at the heel side 106*h* and toe side 106*t*, respectively, of the perimeter weight member 106 of rear weight member 620 (e.g., as described above with respect to the example structure 500 of FIG. 5). This example structure 600, however, additionally includes a third short rib member 612*c* provided at a central area of the club head structure 600. This example rear weight member 620 is rigidly engaged to these three short rib members 612*h*, 612*c*, and 612*t* (e.g., at the heel perimeter weight area 106*h*, at the toe perimeter weight area 106*t*, and at the forward face 620*f* of the rear weight member 620). This type of arrangement of three short rib members (e.g., 612*h*, 612*c*, 612*t*) may be well suited for club head constructions in which the rear weight member 620 has a forward surface 620*f* at least at a location to rigidly engage the center short rib member 612*c*. Again, in this structure 600, if desired, the resilient member(s) 130 may form a ring (or two half rings) that underlies only the perimeter weight area 106 of rear weight member 620 (e.g., resilient member 130 may be in the form of a ring having a through hole, two half rings (one at the top, one at the bottom), etc.).

Although other orientations and arrangements are possible, in this illustrated example, the center short rib member 612*c* generally lies along a line connecting heel rib member 612*h* and toe rib member 612*t*. Alternatively, if desired, the center short rib member 612*c* may be shifted vertically up or down from the generally linear arrangement shown in FIG. 6. Also, the center short rib member 612*c* may extend across any desired portion or proportion of the rear cavity area 108 (e.g., from 0.5% to 99.5% of the distance between ribs 612*h* and 612*t*, and in some examples, from 10% to 90% of that distance, from 15% to 60% of that distance, or even from 20% to 40% of that distance). As another option, if desired, the rear weight member 620 and the face member 110 may be rigidly engaged at more than the three illustrated short rib members 612*h*, 612*c*, 612*t* (e.g., a fourth, fifth, or more short rib members may be provided, if desired, optionally along the same generally linear arrangement or at some other desired arrangement).

The configuration of FIG. 6, with three (or more) short rib members 612*h*, 612*c*, and 612*t*, also may be used in any of the constructions and/or variations described above, including in any of the structures and/or variations described above and/or shown in FIGS. 1A-1G, 2A, 2B, 3A, 3B, and/or 4A-4C.

Figure 7:
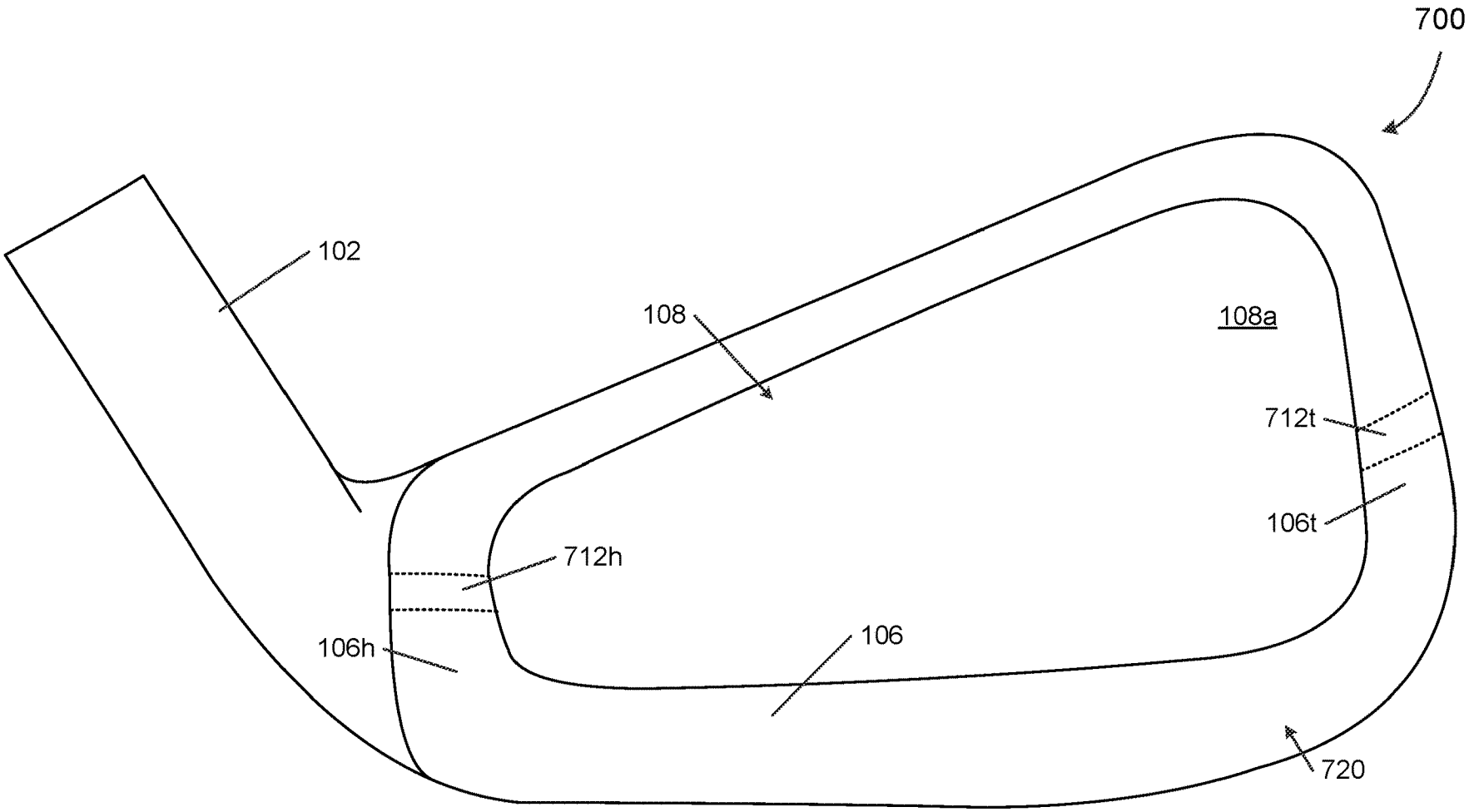
FIG. 7 illustrates a rear view of another example golf club head according to some examples of this invention.

In the examples of FIGS. 5 and 6 in which multiple rib elements are provided, the rib elements may be arranged in a generally linearly aligned manner (e.g., so that the ribs 512*h* and 512*t* lie on a substantially straight line and so that ribs 612*h*, 612*c*, and 612*t* lie on a substantially straight line). Other arrangements are possible. For example, FIG. 7 illustrates a club head structure 700 with a rear weight member 720 mounted on two short rib elements 712*h* and 712*t* at the heel perimeter weight area 106*h* and the toe perimeter weight area 106*t* in a similar manner to the rib members 512*h*, 512*t* shown in FIG. 5, but in the structure 700 of FIG. 7, short rib elements 712*h* and 712*t* are not aligned on a substantially straight line. The rib elements 712*h* and 712*t* may be provided at any desired angle, vertical separation, and/or orientation with respect to one another, they may lie on a predetermined curved line (e.g., on an arc of a circle, ellipse, parabola, etc.), and/or there may be no predetermined geometric relationship between their relatively positioning and/or orientations. If desired, one or more additional rib elements may be provided in the structure 700 of FIG. 7 (e.g., like one or more intermediate or central ribs 612*c* shown in the example structure 600 of FIG. 6). When one or more intermediate or central ribs are present, they may or may not lie on a common line, curve, arc, or other arrangement with respect to one or more of the heel rib 712*h*, the toe rib 712*t*, and/or one another.

The configuration of FIG. 7, with two (or more) short rib members 712*h* and 712*t*, also may be used in any of the constructions and/or variations described above, including in any of the structures and/or variations described above and/or shown in FIGS. 1A-1G, 2A, 2B, 3A, 3B, and/or 4A-4C.

Figure 8A:
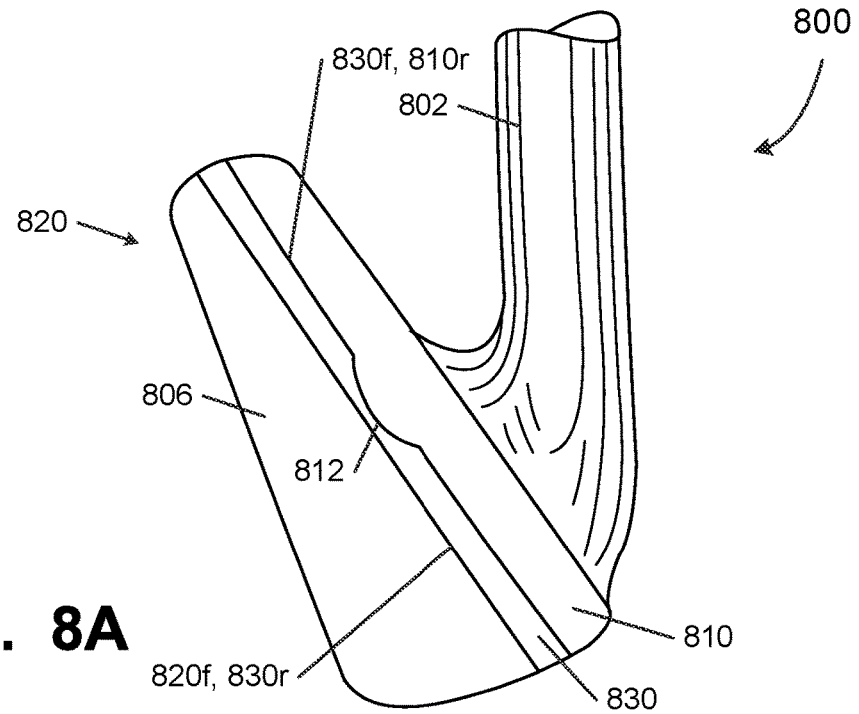
FIGS. 8A and 8B illustrate assembly and parts of an example golf club head according to some examples of this invention.
Figure 8B:
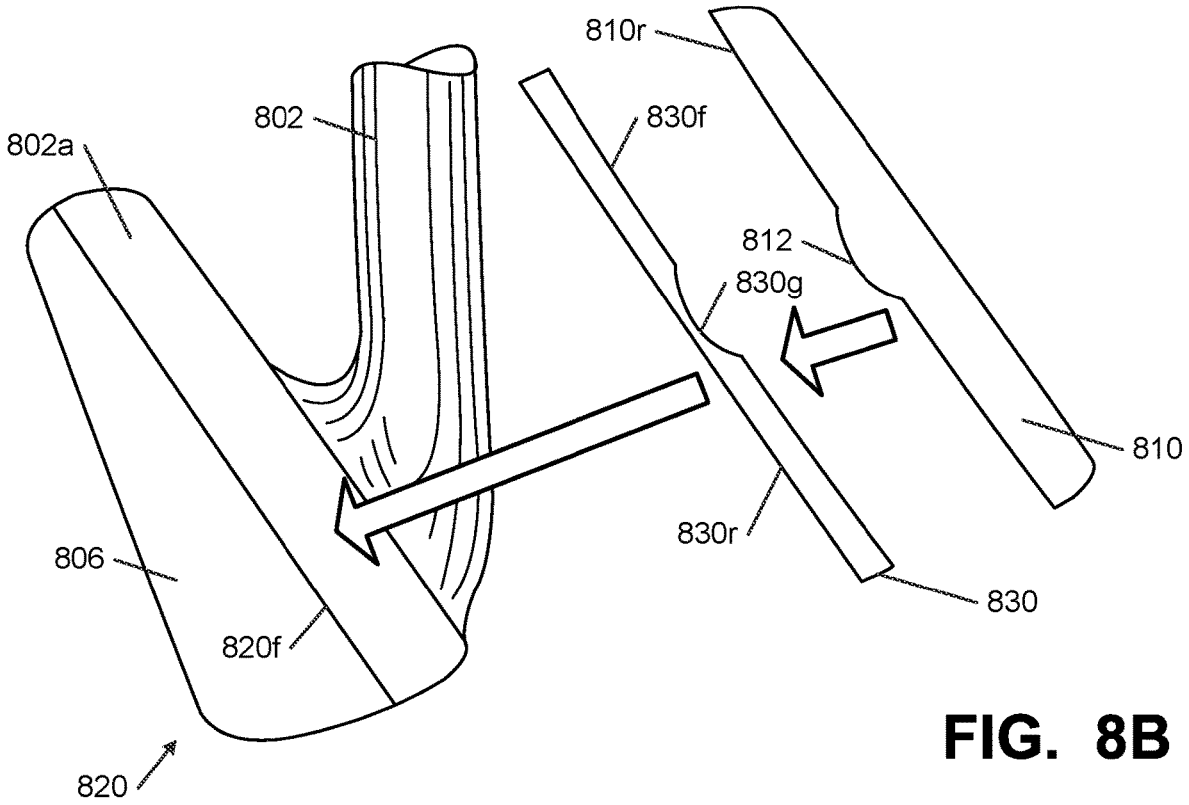

FIGS. 8A and 8B illustrate one example golf club head structure 800 and method of making it in accordance with at least some aspects of this invention. FIG. 8A shows a toe view of the finished golf club head product 800 and FIG. 8B shows its example parts and method of constructing it (e.g., as an exploded view). As shown in these figures, the golf club head 800 includes a rear weight member 820, which in this illustrated example is integrally formed with or attached to a hosel member 802 for engaging a golf club shaft (not shown). The rear weight member 820 may constitute a cavity back/perimeter weighted structure 806 or other desired weight member structure, e.g., of the various types described above in conjunction with FIGS. 1A through 7.

In this example, the hosel area 802 defines a heel wall 802*a* of the club head structure 800 against which the heel sides of the resilient member(s) 830 and/or face member 810 may be mounted when the club head 800 is assembled. Additionally, the front surface 820*f* of the perimeter weight portion 806 of the rear weight member 820 (and optionally an entire front surface 820*f* of the rear weight member 820) also provides a surface against which at least the resilient member(s) 830 is (are) mounted. As an alternative to simply a heel side wall 802*a*, if desired, the hosel member 802 and/or the rear weight member 820 may define two or more perimeter walls, or optionally an entire perimeter chamber, in which the resilient member(s) 830 and/or face member 810 can be mounted. As another option, if desired, the additional heel wall 802*a* at the hosel area 802 could be omitted (and the resilient member 830 and face member 810 may be mounted only on the forward face 820*f* of the rear weight member 820).

As illustrated in FIGS. 8A and 8B, the rear surface 810*r* of the ball striking face member 810 includes at least one raised rib element 812. In this illustrated example, the raised rib element 812 fits within a groove 830*g* formed in the front surface 830*f* of the resilient member(s) 830. Alternatively, the resilient member 830 may be made of separate parts and/or include a gap so that the raised rib 812 can rigidly and/or directly engage at least some portion of the front surface 820*f* of rear weight member 820 (e.g., at least at locations associated with the heel and toe portions of the perimeter weight 806). The ball striking face 810, rear weight member 820, raised rib(s) 812, and/or resilient member(s) 830 may take on any of the forms, options, and/or alternatives described above with respect to FIGS. 1A through 7.

To fabricate the club head 800: (a) the ball striking face portion 810 may be engaged with the resilient member(s) 830 (e.g., surface 810*r* engaged with surface 830*f* with rib 812 extending into groove 830*g*, if any, for example, using one or more of adhesives or cements, other fusing techniques, mechanical connectors, etc.) and (b) the resilient member(s) 830 may be engaged with the rear body member 820 (e.g., rear surface 830*r* engaged with surface 820*f*, for example, using one or more of adhesives or cements, other fusing techniques, mechanical connectors, etc.). These engagement steps may take place in any desired order (e.g., the resilient member(s) 830 may be first engaged with the face member 810 and then this unit may be engaged with the rear body member 820 or the resilient member(s) 830 may be first engaged with the rear body member 820 and then this unit may be engaged with the face member 810), or the engagement steps may take place simultaneously. The face member 810 and/or resilient member(s) 830 also may be engaged with the heel side wall 802*a* of the rear body member 820/hosel member 802, if a heel wall 802*a* is present (e.g., using one or more of adhesives or cements, other fusing techniques, mechanical connectors, etc.), if desired.

Figure 9:
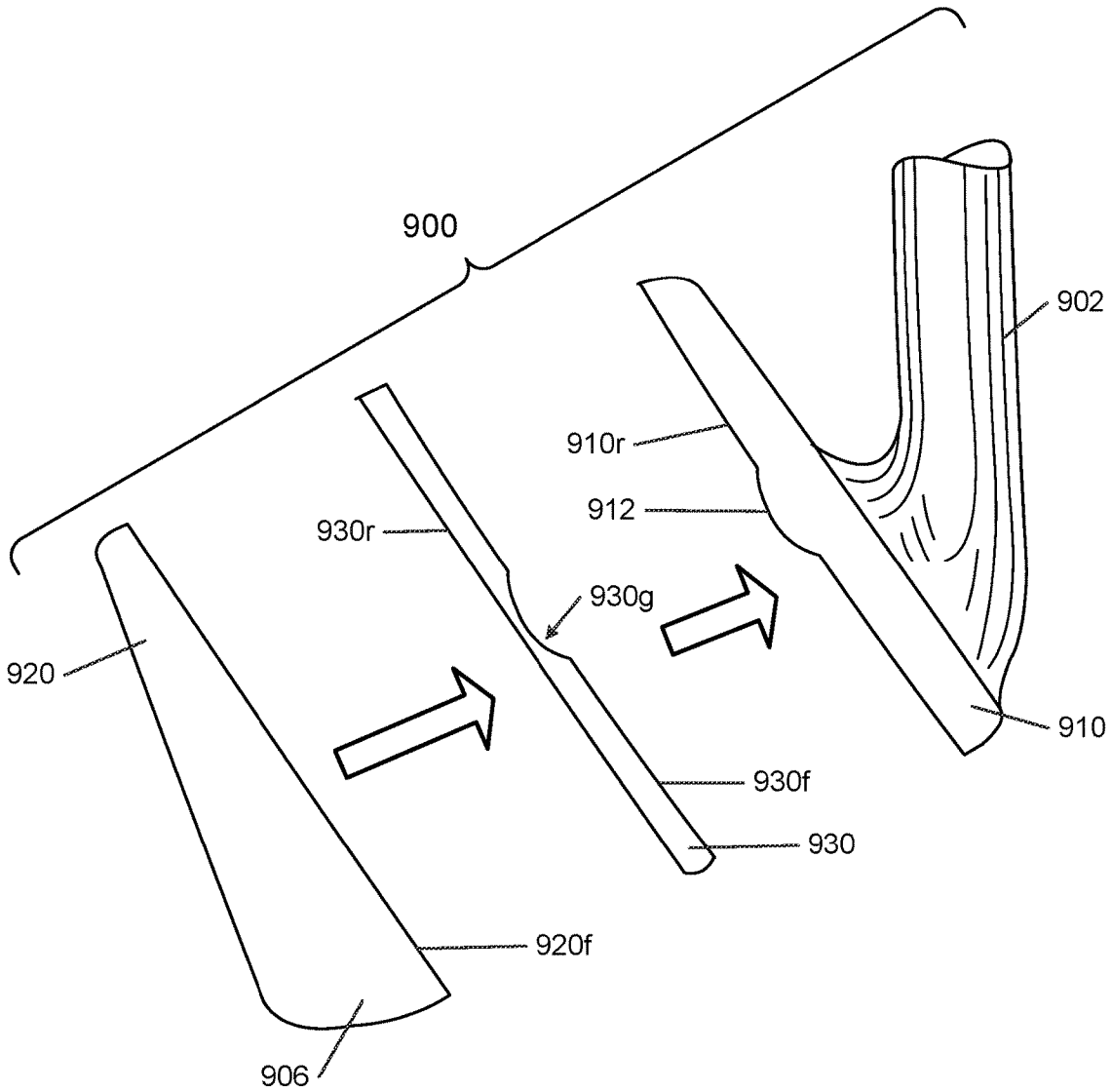
FIG. 9 illustrates assembly and parts of an example golf club head according to some examples of this invention.

In the example structure 800 and method illustrated in FIGS. 8A and 8B, the hosel member 802 is engaged with, integrally formed with, and/or is otherwise connected to the rear weight member 820. Other options are possible. For example, FIG. 9 illustrates another example golf club head structure 900 and method of making it in accordance with at least some aspects of this invention. As shown in this figure, the golf club head 900 includes a rear weight member 920, which in this illustrated example is separately formed from the hosel member 902 for engaging a golf club shaft (not shown). Rather, the hosel member 902 in this illustrated example is engaged with, integrally formed with, or otherwise connected to the face member 910. The rear weight member 920 may constitute a cavity back/perimeter weighted structure 906 or other desired type of weight member, e.g., of the various types described above in conjunction with FIGS. 1A through 7.

Although not shown in this example, the hosel area 902 may define a heel wall of the club head structure 900 against which the heel sides of the resilient member(s) 830 and/or rear weight member 920 may be mounted when the club head 900 is assembled (e.g., akin to heel wall 802*a* described above). Additionally or alternatively, the front surface 920*f* of the perimeter weight portion 906 of the rear weight member 920 (and optionally an entire front surface 920*f* of the rear weight member 920) provides a surface against which at least the resilient member(s) 930 is (are) mounted. As an alternative to simply a heel side wall, if desired, the hosel member 902 and/or the front face member 910 may define two or more perimeter walls, or optionally an entire perimeter chamber, in which the resilient member(s) 930 and/or rear weight member 920 can be mounted. In this illustrated example, however, the additional heel wall at the hosel area 902 is omitted, and the resilient member(s) 930 and the rear weight member 920 are mounted to the rear surface 910*r* of face member 910.

As illustrated in FIG. 9, the rear surface 910*r* of the ball striking face member 910 includes at least one raised rib element 912. In this illustrated example, the raised rib element 912 fits within a groove 930*g* formed in the front surface 930*f* of the resilient member(s) 930. Alternatively, the resilient member 930 may be made of separate parts and/or include a gap so that the raised rib 912 can rigidly and/or directly engage at least some portion of the front surface 920*f* of rear weight member 920 (e.g., at least at locations associated with the heel and toe portions of the perimeter weight 906). The ball striking face member 910, rear weight member 920, raised rib(s) 912, and/or resilient member(s) 930 may take on any of the forms, options, and/or alternatives described above with respect to FIGS. 1A through 7.

To fabricate the club head 900: (a) the ball striking face portion 910 may be engaged with the resilient member(s) 930 (e.g., surface 910*r* engaged with surface 930*f* with rib 912 extending into groove 930*g*, if any, for example, using one or more of adhesives or cements, other fusing techniques, mechanical connectors, etc.) and (b) the resilient member(s) 930 may be engaged with the rear body member 920 (e.g., rear surface 930*r* engaged with surface 920*f*, for example, using one or more of adhesives or cements, other fusing techniques, mechanical connectors, etc.). These engagement steps may take place in any desired order (e.g., the resilient member(s) 930 may be first engaged with the face member 910 and then this unit may be engaged with the rear body member 920 or the resilient member(s) 930 may be first engaged with the rear body member 920 and then this unit may be engaged with the face member 910), or these engagement steps may take place simultaneously. The rear body member 920 and/or resilient member(s) 930 also may be engaged with the heel side wall of the front face member 910/hosel member 902, if a heel side wall is present (e.g., using one or more of adhesives or cements, other fusing techniques, mechanical connectors, etc.).

The example structures of FIGS. 1A through 9 illustrate golf club head structures in which an outer perimeter edge or side of the resilient member or members are visible and extend continuously at least around the top, toe, and sole edges of the club head structures (and optionally, are visible and extend continuously 360° around the club head perimeter structure). In at least some examples, the rear weight member(s) are indirectly attached to the ball striking face member(s) at all locations (except potentially at the raised rib peak location(s)) through the resilient element(s). Even at the raised rib location(s), the rear weight member(s) and the face member(s) may simply abut one another and are not necessarily permanently fixed to one another (e.g., not necessarily fixed by welding, fusing techniques, adhesives or cements, mechanical connectors, etc.). While other features are possible, at least some example structures according to at least some aspects of this invention may have the features described above.

Also, in these illustrated example structures, the raised rib element(s) extend in a generally heel-to-toe direction, e.g., such that the mass-damping as described above is activated at least on balls hit on the ball striking face above and/or below the raised rib elements. Other options are possible.

For example, rather than a rib type structure, the rear weight member(s) may contact and/or be fixed to the face member at one or more "point" locations, with one or more resilient members located around the one or more "point" engagement locations. In some more specific examples, rather than a raised rib structure, a front surface of the rear weight member and/or the rear surface of the face member may include one or more raised connection points (e.g., a dome, pyramid, flat topped pyramid, or similar feature) that contact and/or otherwise extend to a location close to the surface of the other component. The raised connection points may create a direct contact between the rear body member(s) and the face member (e.g., like the direct connections shown and described above in conjunction with FIGS. 1A-1G, 2A, 2B, and 4A-4C) or a layer of the resilient member may lie between the rear body member and the face member at the raised connection point(s) (e.g., like the indirect connections shown and described above in conjunction with FIGS. 3A and 3B).

FIGS. 10A-13 illustrate examples of club head structures 1000, 1100, 1150, 1200, 1300 having one, two, three, three, and four of these "point" type engagement locations 1002, respectively. While other connection structures are possible, the point type engagements at locations 1002 may have raised connection point structures, e.g., of the types shown in FIGS. 26-33 of U.S. Patent Appln. Publication No. 2013/0137533 A1 (e.g., including the structures described in Paragraphs [0152]-[0160] therein). U.S. Patent Appln. Publication No. 2013/0137533 A1 is incorporated herein by reference in its entirety. The connection point structures may have cross sectional shapes in the form of domed, curved, or rounded structures (e.g., in section shaped like element 112 in FIG. 1G), sharp peaks or more pointed, pyramid structures (e.g., in section shaped like element 212 in FIG. 2A), shapes like FIG. 2A but with a more rounded peak (instead of a sharp point), flattened peaks or pyramid shaped structures (e.g., in section shaped like element 222 in FIG. 2B), etc.

The example club head structures of FIGS. 10A-13 may have rear weight member(s), resilient member(s), face member(s), and/or hosel member(s) of the type described above in conjunction with FIGS. 1A-4, 8A, 8B, and 9, e.g., in which an outer perimeter edge or side of the resilient member or members are visible and extend continuously at least around the top, toe, and sole edges of the club head structures (and optionally, are visible and extend continuously 360° around the club head perimeter structure). Thus, in at least some examples, the club head structures 1000, 1100, 1150, 1200, 1300 of FIGS. 10A and 11A-13 may have top, sole, toe, and heel structures and views similar to those shown in FIGS. 1C-1G, 2A, 2B, 3A, 3B, 4A-4C, 8A, 8B, and 9, including any variations described above with respect to these structures, including the raised ribs, if desired. Alternatively, as shown in FIGS. 10B and 10C, in the structures of FIGS. 10A and 11A-13, the previously described raised ribs may be omitted and connection points 1002 may serve as the rigid engagement/incompressible connection structure for the face member 1010 and rear body member 1020 (with a resilient material 1030 between these parts and/or optionally located around the connection point(s) 1002). The connection point(s) 1002 may be made of a hard, durable, and/or substantially incompressible material (at least as compared to the material of the resilient member(s)) so as to define one or more areas of low compressibility in the club head 1000, 1100, 1150, 1200, 1300 around the vicinity of the connection point(s) 1002 (with higher compressibility areas away from the connection point(s) 1002 due to the presence of the resilient material).

While the connection point structures at locations 1002 may be formed as integral parts with the face member or weight member, this is not a requirement. Rather, if desired, in any of the example structures described above (and/or those described in more detail below), the connection point structures at locations 1002 may be formed as separate parts from the ball striking face member and/or the weight member, and these separate parts may be engaged with the ball striking face member and/or the weight member. When formed as separate parts, the materials of the connection point structures at locations 1002 may be more rigid than the material of at least the resilient member. The connection point structures at locations 1002 may be engaged with the face member and/or weight member by welding or other fusing techniques; by adhesives or cements; by one or more mechanical connectors (e.g., screws, bolts, etc.); or the like). As yet other options, the connection point structures at locations 1002 may be parts engaged with the resilient member (e.g., by adhesives or cements; by one or more mechanical connectors (e.g., screws, bolts, etc.); or the like). The connection point structures at locations 1002 also could constitute polymer materials engaged with the resilient member, face member, and/or weight member, e.g., by co-molding, etc.

In at least some of the example structures 1000, 1100, 1150, 1200, 1300 of FIGS. 10-13, the rear weight member 1020 will include a forward wall 1020*f* through which the rear weight member 1020 is engaged with the face member at the connection point(s) 1002 (e.g., using one or more of the various connection structures described above). While the forward wall 1020*f* may completely close the cavity 1008 in the area within the perimeter weight member 1006, this is not a requirement.

Figure 10A:
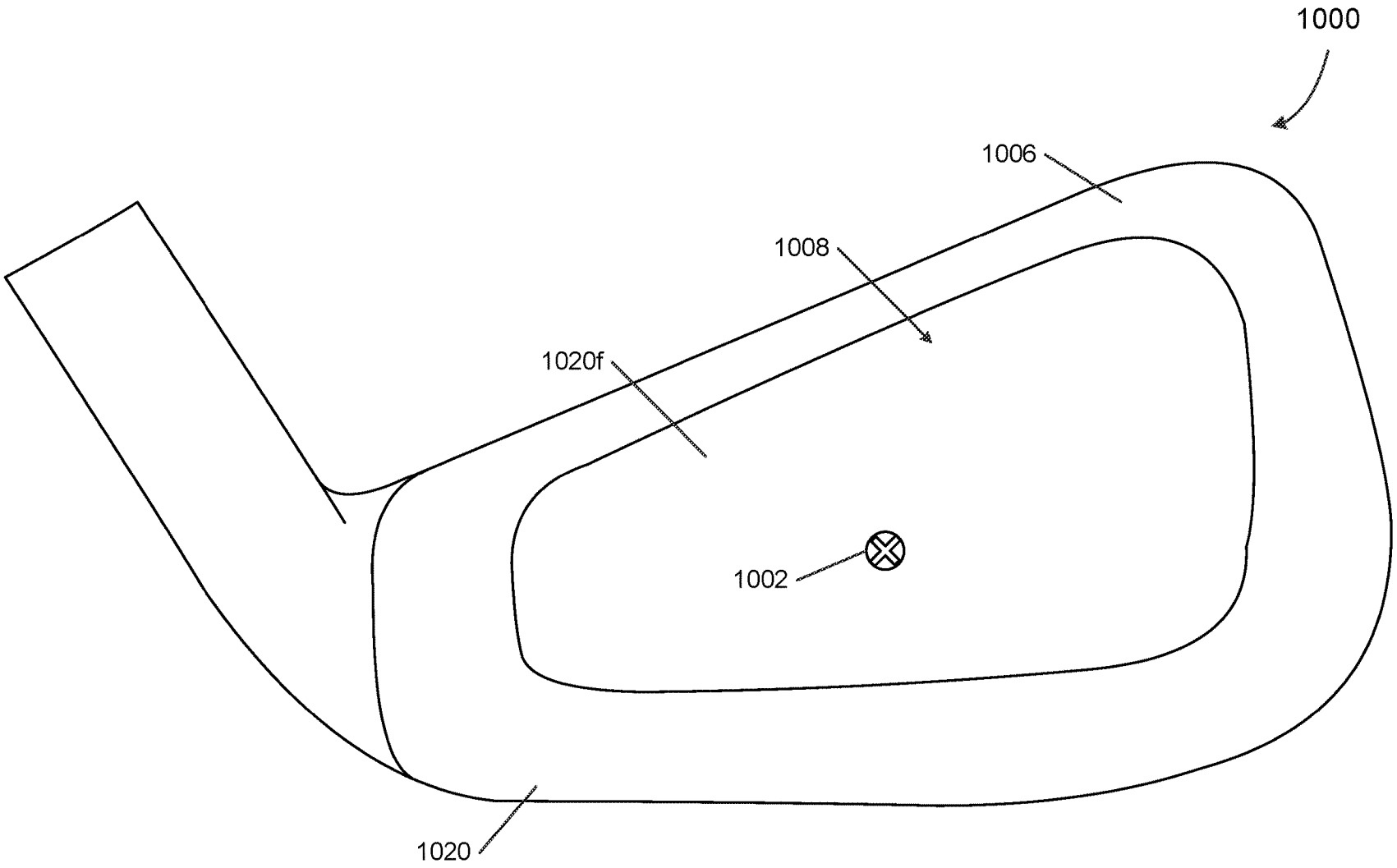
FIGS. 10A-13 illustrate golf club heads according to some examples of this invention with different sets and arrangements of contact or connection points.
Figure 10C:
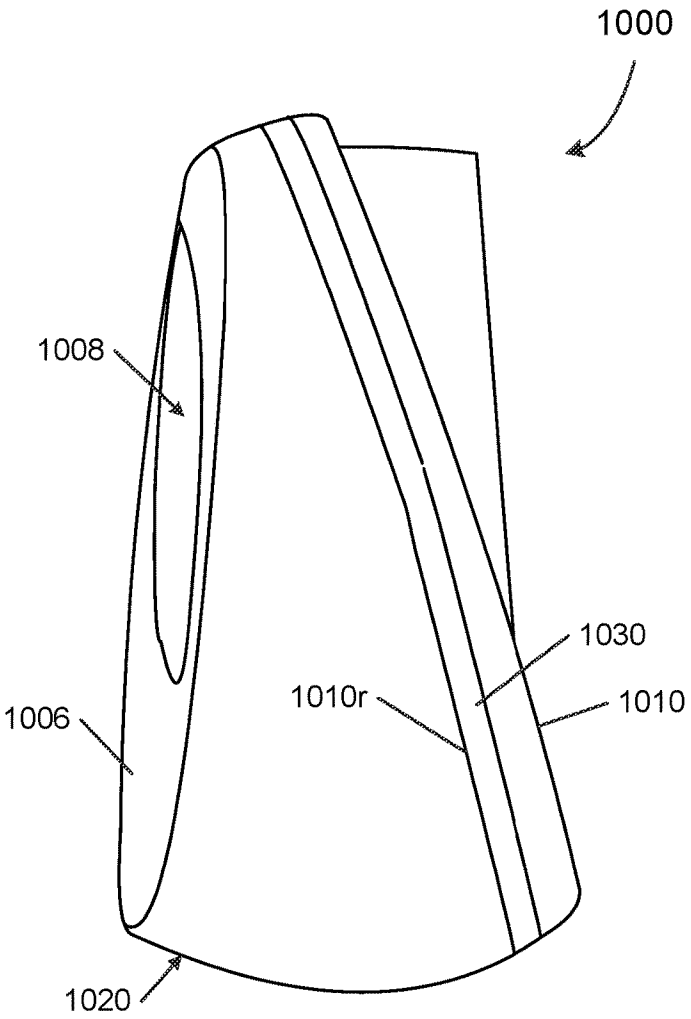
Figure 10B:
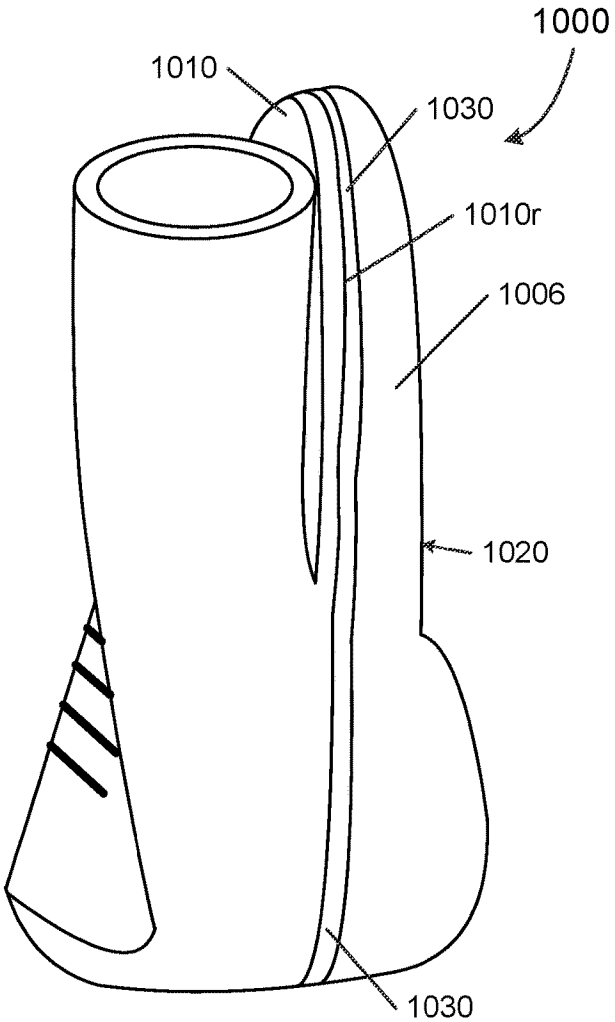

In the example of FIGS. 10A-10C, a single connection point 1002 is provided (although, as described above with respect to FIGS. 8A-9, the rear body member 1020 may be indirectly engaged with the ball striking face member 1010 through the resilient member(s) 1030, e.g., by adhesives or cements, by fusing techniques, etc.). While other locations are possible, if desired, the connection point location 1002 may be provided at a location such that the peak of the connection point 1002 lies on a line perpendicular to the ball striking face that passes through the club head 1000 center of gravity G (e.g., see FIG. 1G). In this manner, the force generated by balls struck in line with the club head's center of gravity will receive maximum support by the connection point 1002. On balls struck off center on the club head face, the resilient member 1030 (which may surround the connection point 1002) will compress as described above and activate mass-damping.

In the example structure 1000 of FIGS. 10A-10C, the club head 1000 includes a single connection point 1002 with resilient member 1030 around this connection point 1002 (e.g., at least between the face member 1010 and the rear weight member 1020 around the perimeter weight 1006 area). Thus, off center shots in any direction from connection point 1002 will experience enhanced feel as a result of the mass damping that results from the cyclical compression-decompression of the deflection of resilient member 1030 initiated by momentum of the rear weight member 1020. The connection point location 1002 also may vary over the course of a set of irons, e.g., optionally with different connection point locations 1002 depending on the loft of the club head. The connection point 1002 defines an area or region 1002*c* of low compressibility around itself, due to its relatively incompressible nature (at least as compared to the higher compressibility of the resilient material).

Figure 11A:
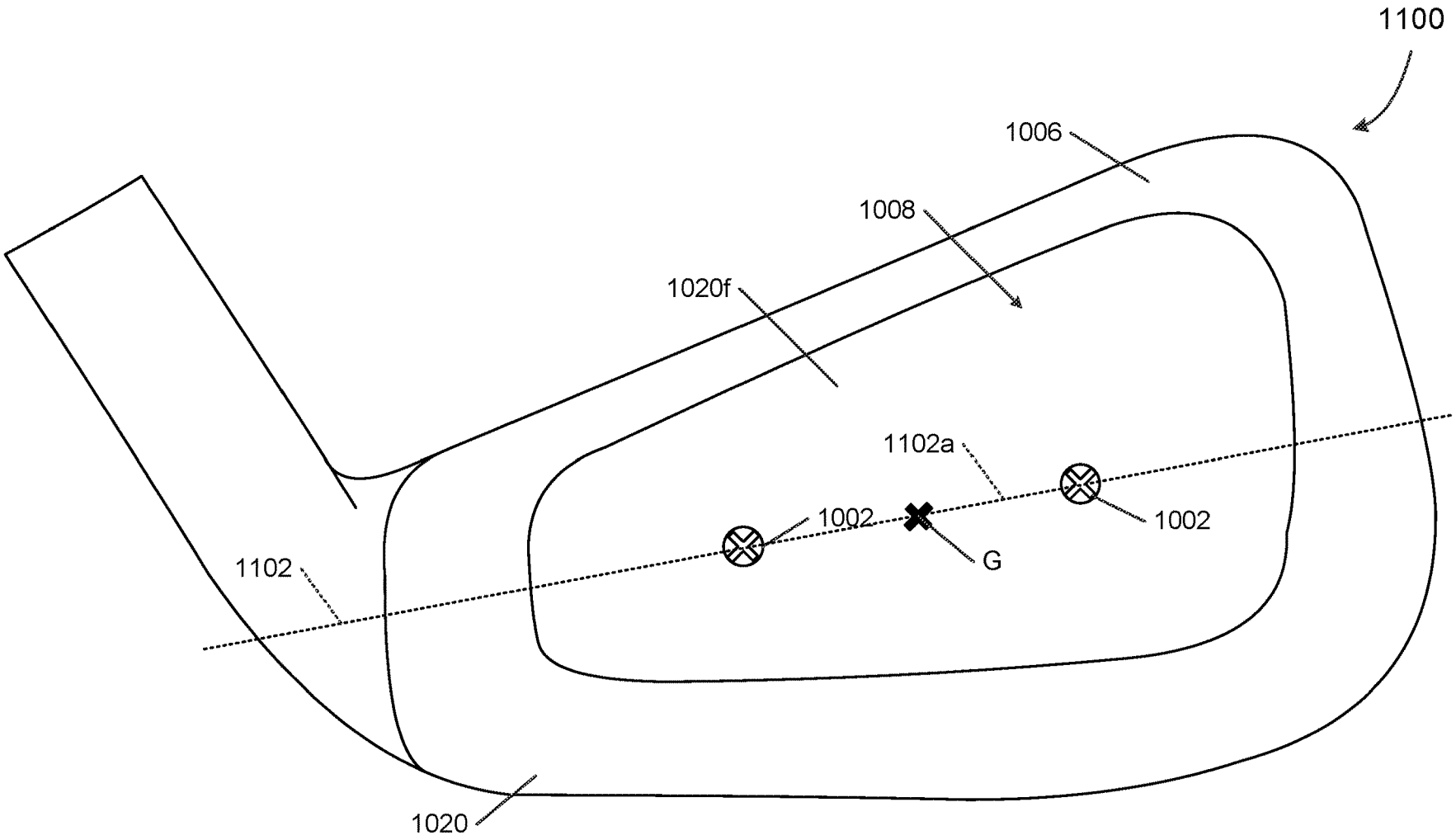

In the club head structure 1100 of FIG. 11A (which may have toe and heel views like those of FIGS. 10B and 10C), two connection points 1002 are provided within the cavity 1008 of the perimeter weight 1006. The two connection points 1002 may define a line 1102 of increased face support, particularly at portions 1102*a* of the line 1102 between the two connection points 1002, and in this manner, the two connection points 1002 may function in a manner similar to the generally linear raised rib structures described above. More specifically, the two connection points 1002 may define opposite ends of a supported region (or a region of low compressibility 1102*c*) behind the ball striking face member 1010 that acts like the raised ribs and/or region of low compressibility described above. The pair of connection points 1002 define an elongated area or region 1102*c* of low compressibility around them, due to their relatively incompressible nature (at least as compared to the higher compressibility of the resilient material). On hits generally aligned with the line 1102, minimal or no compressibility of the resilient member 1030 is experienced, resulting in a direct, solid feeling hit. On off-center hits above and below the line 1102, however, the momentum of the rear weight member 1020 will compress the resilient member 1030 as described above and thereby provide mass-damping as generally described above for linear ribs. Optionally, if desired, the structure 1100 of FIG. 11A could be used in combination with some raised rib structures, e.g., like those described above in conjunction with FIGS. 5-7.

In at least some examples of the structure 1100 shown in FIG. 11A, the line 1102 will be oriented in a manner so as to extend parallel to groove lines on the ball striking face of the club head 1100. Additionally or alternatively, if desired, the line 1102 may be oriented such that the line 1102 (and optionally the line segment 1102*a* between the connection points 1002) and/or a midpoint of that line segment 1102*a*) extends through the club head 1100's center of gravity G or intersects a line perpendicular to the ball striking face that passes through the club head 1100 center of gravity G. In this manner, balls struck in line with the club head 1100's center of gravity will result in significantly less compression of resilient member 1030, having a more direct, solid feel, and off-center hits will have enhanced feel resulting from mass-damping as described above. The connection point locations 1002 and/or their relative orientation with respect to one another on the club head 1100 may vary over the course of a set of irons, e.g., optionally with different connection point locations 1002 and/or relative orientations depending on the loft of the club head 1100.

Figure 11B:
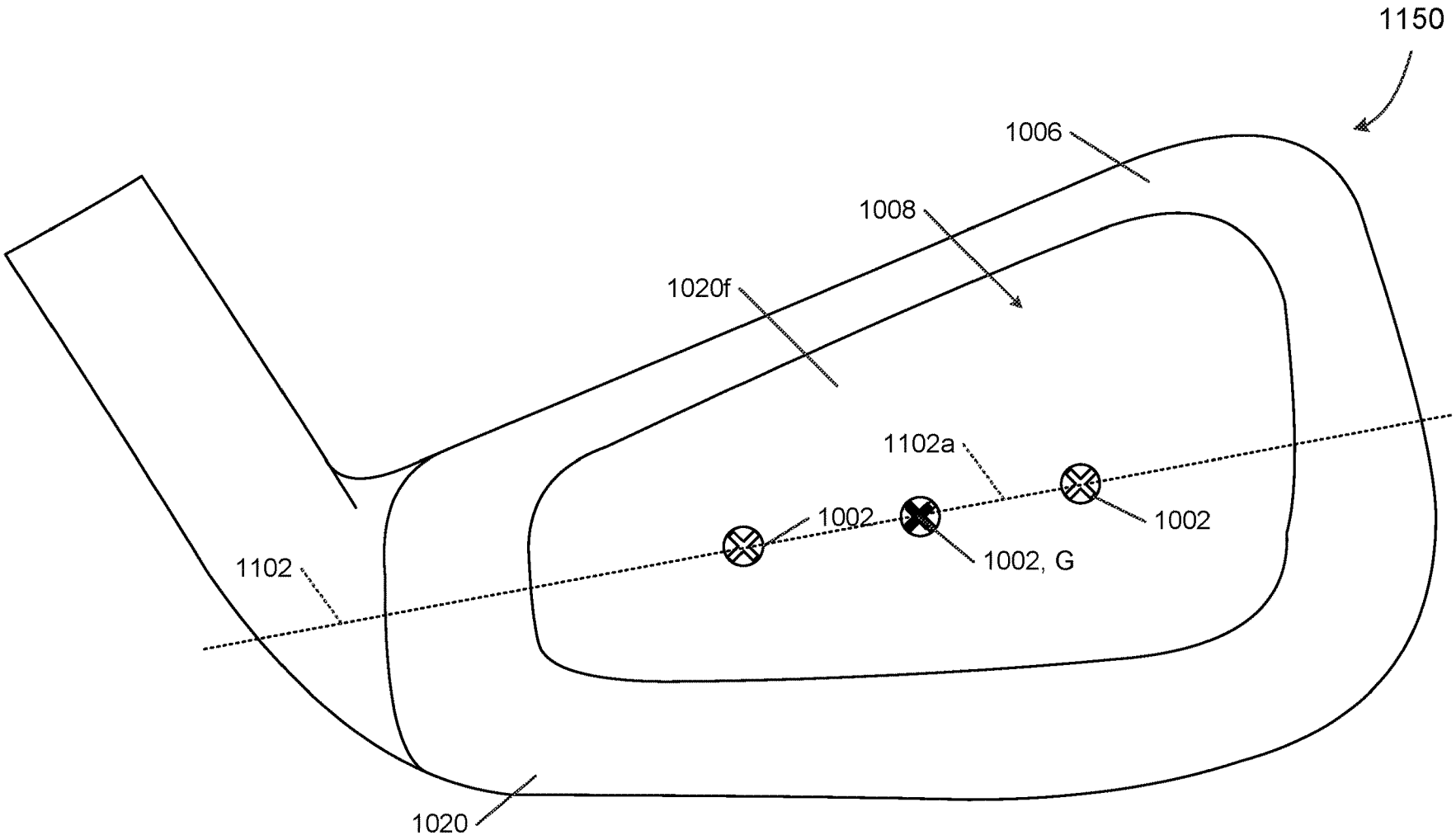

Turning now to the club head structure 1150 of FIG. 11B, as another option, if desired, a third (or more) connection points 1002 may be provided along line 1102. As one more specific example, if desired, one additional connection point 1002 could be provided on line segment 1152*a* at or at a location in line with the club head 1100's center of gravity G (e.g., the additional connection point 1002 is provided on line segment 1152*a* at the location marked G in FIG. 11B).

In the club head structure 1150 of FIG. 11B (which may have toe and heel views like those of FIGS. 10B and 10C), three connection points 1002 are provided within the cavity 1008 of the perimeter weight 1006. The three connection points 1002 of this example may define a line 1152 of increased face support, particularly at portions 1152*a* of the line 1152 between the connection points 1002 closest to the heel and toe ends of the club head 1150. In this example structure 1150, the three connection points 1002 may function in a manner similar to the generally linear raised rib structures described above. More specifically, the three connection points 1002 may define a supported region (or a region of low compressibility 1152*c*) behind the ball striking face member 1010 that acts like the raised ribs and/or region of low compressibility described above. The three connection points 1002 define an elongated area or region 1152*c* of low compressibility around them and between them, due to their relatively incompressible nature (at least as compared to the higher compressibility of the resilient material). On hits generally aligned with the line 1152, minimal or no compressibility of the resilient member 1030 is experienced, resulting in a direct, solid feeling hit. On off-center hits above and below the line 1152, however, the momentum of the rear weight member 1020 will compress the resilient member 1030 as described above and thereby provide mass-damping as generally described above for linear ribs. Optionally, if desired, the structure 1150 of FIG. 11B could be used in combination with some raised rib structures, e.g., like those described above in conjunction with FIGS. 5-7.

In at least some examples of the structure 1150 shown in FIG. 11B, the line 1152 will be oriented in a manner so as to extend parallel to groove lines on the ball striking face of the club head 1100. Additionally or alternatively, if desired, the line 1152 may be oriented such that the line 1152 (and optionally the line segment 1152*a* between the connection points 1002) and/or a midpoint of that line segment 1152*a*) extends through the club head 1150's center of gravity G or intersects a line perpendicular to the ball striking face that passes through the club head 1150 center of gravity G. In this manner, balls struck in line with the club head 1150's center of gravity will result in significantly less compression of resilient member 1030, having a more direct, solid feel, and off-center hits will have enhanced feel resulting from mass-damping as described above. The connection point locations 1002 and/or their relative orientation with respect to one another on the club head 1100 may vary over the course of a set of irons, e.g., optionally with different connection point locations 1002 and/or relative orientations depending on the loft of the club head 1150.

Figure 12:
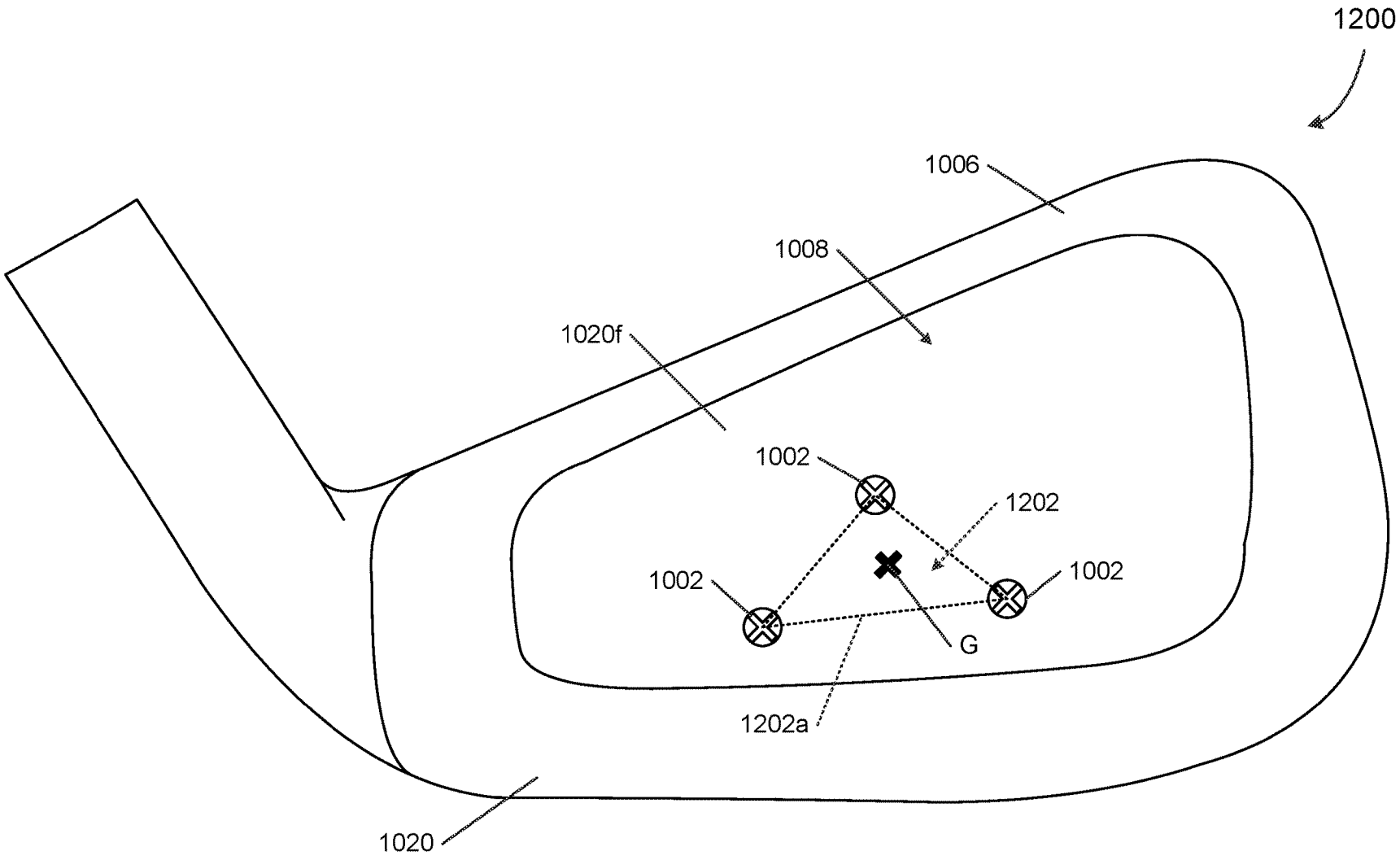

The club head structure 1200 of FIG. 12 (which may have toe and heel views like those shown in FIGS. 10B and 10C) includes three connection points 1002 within the cavity 1008 of the perimeter weight 1006. In this illustrated example, however, the three connection points 1002 are arranged in a triangular pattern and may define an area 1202*c* of increased face support (and lower compressibility), particularly at the area 1202 within a perimeter 1202*a* defined by the connection points 1002. As shown in FIG. 12, however, the area 1202*c* of lower compressibility may extend somewhat outside of the perimeter 1202*a*. If desired, as shown in FIG. 12, the connection points 1002 may be arranged with respect to one another such that the club head 1200's center of gravity is located within the increased support area 1202*a* and/or within the interior area 1202 and/or a line extending rearward and perpendicular to the ball striking face member 1010 and passing through the club head 1200's center of gravity G will pass through the increased support area 1202*a* and/or the interior area 1202. Optionally, in some example structures 1200, the club head 1200's center of gravity G will be located at the geographic center of the increased support area 1202 within the perimeter 1202*a* and/or the line extending rearward and perpendicular to the ball striking face member 1010 and passing through the club head 1200's center of gravity G will pass through the geographic center of the increased support area 1202 within the perimeter 1202*a*.

In this example club head structure 1200, balls struck in line with the area 1202*a* of increased support (and/or area 1202 within the perimeter 1202*a*) will result in significantly less compression of the resilient member 1030 than balls struck outside of the increased support area 1202*a* and/or area 1202 within the perimeter 1202*a*. For balls struck outside of the increased support area 1202*a* and/or 1202 within the perimeter 1202*a*, the momentum of the rear weight member 1020 will compress the resilient member 1030, and users thereby will experience enhanced feel as a result of the mass damping that results from the cyclical compression-decompression of the deflection of resilient member 1030. Optionally, if desired, the structure 1200 of FIG. 12 (as well as the structure 1300 of FIG. 13 described below) could be used in combination with some raised rib structures, e.g., like those of FIGS. 5-7.

The locations and/or orientations of connection points 1002 (and thus the size, shape, and orientation of increased support area 1202) may vary widely in such structures 1200. In some examples, as shown in FIG. 12, two of the connection points 1002 may be oriented to provide a bottom base 1202*a* of the triangular support region 1202 and a bottom line of increased support. This bottom base 1202*a* may be oriented in a manner so as to extend parallel to groove lines on the ball striking face member 1010 of the club head 1200. In this manner, balls struck below this bottom base 1202*a* of support will benefit from mass-damping as described above. The connection point locations 1002 and/or their relative orientations with respect to one another on the club head 1200 may vary over the course of a set of irons, e.g., optionally with different connection point locations 1002 and/or relative orientations depending on the loft of the club head.

Figure 13:
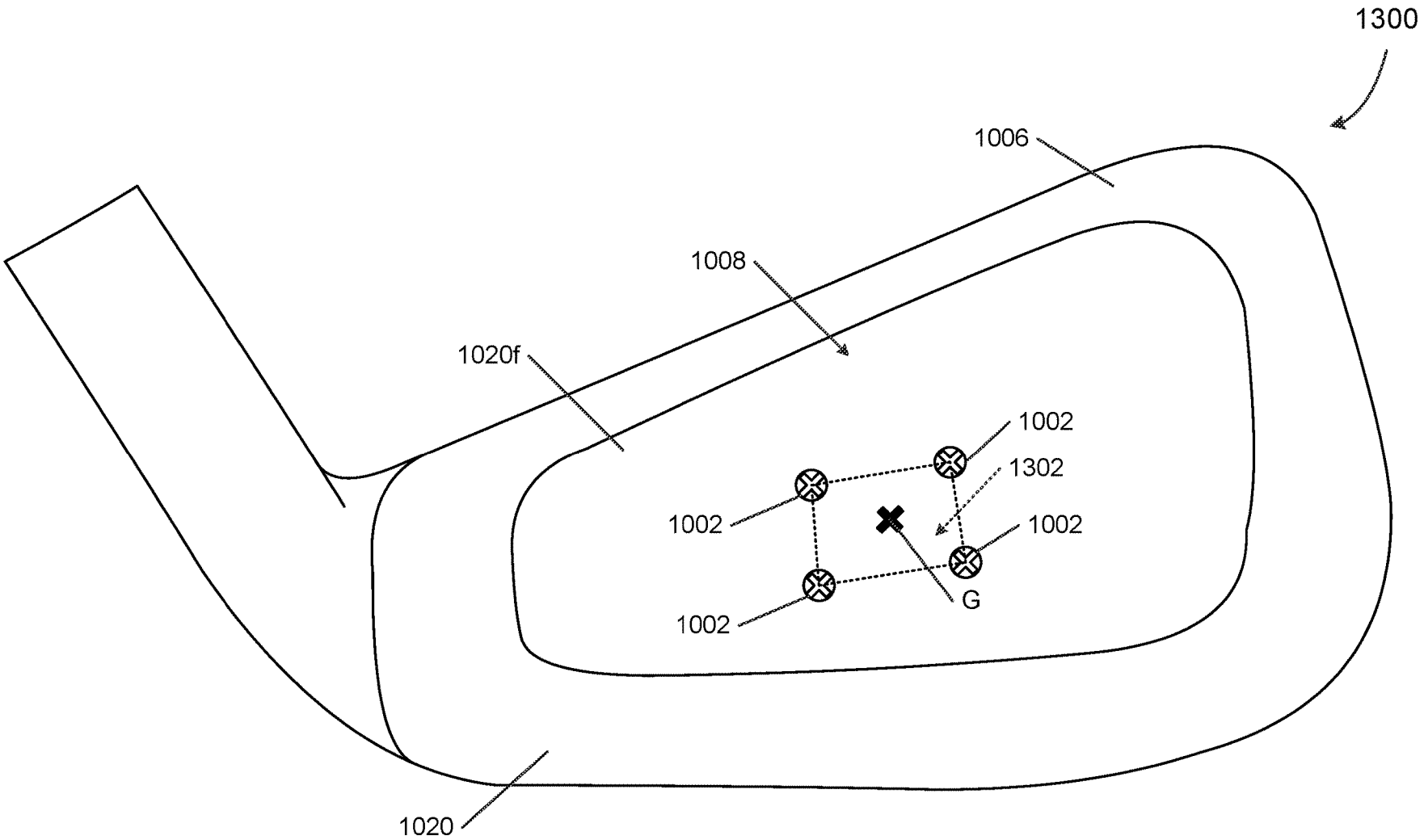

Other shapes and numbers of connection points 1002 may be provided to produce other types of areas of increased support. FIG. 13 illustrates an example with four connection points 1002 providing a four-sided polygonal area 1302*c* of increased support/low compressibility. Any desired four sided (or more sided) polygonal area of increased support may be provided in other example club head structures. While not a requirement, if desired, at least some of the line segments connecting adjacent connection points 1002 and forming the perimeter 1302*a* of interior supported area 1302 may be oriented in a manner so as to extend parallel to groove lines on the ball striking face of the club head 1300. Also, if desired, the area 1302*a* of increased support and/or interior area 1302 within the perimeter 1302*a* may be located such that the club head 1300's center of gravity G is located within the increased support area 1302 and/or such that a line extending rearward and perpendicular to the ball striking face and passing through the club head 1300's center of gravity G will pass through the increased support area 1302 and/or interior area 1302 within the perimeter 1302*a*. The connection point locations 1002 and/or their relative orientations with respect to one another on the club head 1300 may vary over the course of a set of irons, e.g., optionally with different connection point locations 1002, different numbers of connection points 1002, and/or relative orientations of the connection points 1002 depending on the loft of the club head.

In the various examples described above in FIGS. 10A-13, the connection points 1002 are separate elements (or engagement members) that provide the low compressibility areas between the face member and the rear weight member. In these illustrated examples, each connection point structure 1002 is shown as a separate element that is integrally formed with or connected to at least one of the face member, the rear weight member, and/or the resilient member. Other options are possible, however, without departing from this invention. For example, if desired, two or more structures for the connection points 1002 may be formed of a single part, e.g., connected by a strip or web of material, and this multi-connection point part then may be engaged with at least one of the face member, the rear weight member, and/or the resilient member. A single club head may contain both (a) one or more individually or integrally formed connection points 1002 and (b) one or more multi-connection point parts.

As mentioned above, in accordance with at least some examples, an elastic modulus and/or hardness of the material of the resilient member(s) (e.g., 130, 830, 930, 1030) (e.g., polyurethanes (including thermoplastic polyurethanes and thermoset polyurethanes) or elastomers) will be significantly less than an elastic modulus and/or hardness of one or more of (and optionally, each of) the material of the ball striking face member (e.g., 110, 810, 910, 1010), the material of the rear weight member (e.g., 120, 420, 520, 620, 720, 820, 920, 1020), and/or the material of the engagement member (e.g., 112, 212, 222, 412, 512, 612, 712, 812, 912, 1002). In some examples, the elastic modulus of the material of the engagement member (e.g., 112, 212, 222, 412, 512, 612, 712, 812, 912, 1002) will be at least 500 times the elastic modulus of the material of the resilient member(s) (e.g., 130, 830, 930, 1030). The ball striking face members, the rear weight members, and/or the engagement members described above may be made from metal, metal alloy, and/or polymeric materials (e.g., fiber reinforced plastics), as described above (including materials conventionally used in golf club head construction).

With respect to these elastic moduli (or Young's moduli), the material of the ball striking face member (e.g., 110, 810, 910, 1010), the material of the rear weight member (e.g., 120, 420, 520, 620, 720, 820, 920, 1020), and/or the material of the engagement member (e.g., 112, 212, 222, 412, 512, 612, 712, 812, 912, 1002) may have a Young's modulus within the range of about 15 GPa to about 300 GPa, and in some examples, within a range of about 60 GPa to about 225 GPa, or even about 70 GPa to about 200 GPa. As some more specific examples, 6-4 Titanium has a Young's modulus of about 110 GPa, 17-4 stainless steel has a Young's modulus of about 195 GPa, and a fiber-reinforced plastic (FRP) or other composite material may have a Young's modulus of at least 50 GPa. The resilient member (e.g., members 130, 830, 930, 1030) material (e.g., polyurethanes (including thermoplastic polyurethanes and thermoset polyurethanes) or elastomers), on the other hand, may have a Young's modulus of 5000 MPa or less, and in some examples, within the range of about 500 MPa to about 5000 MPa or even from about 1000 MPa to about 4000 MPa. In at least some examples, the material of the ball striking face member, the material of the rear weight member, and/or the material of the engagement member may have a Young's modulus that is at least 20× greater, at least 50× greater, at least 100× greater, or even at least 500× greater than the Young's modulus of the resilient member material. Other materials having other moduli and/or other hardnesses also may be used.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An iron-type golf club head, comprising:

a ball striking face member including a rear surface and a ball striking face;

a rear weight member including a front surface, at least one resilient member between the front surface of the rear weight member and the rear surface of the ball striking face member, wherein the front surface of the rear weight member and the rear surface of the ball striking face member face one another and define a space therebetween;

wherein the at least one resilient member is disposed within the space, wherein the ball striking face member comprises a first material having a first hardness, wherein the rear weight member comprises a second member having a second hardness, and wherein the at least one resilient member comprises at least a third hardness, wherein no portion of the at least one resilient member comprises a hardness greater than any portion of the ball striking face member or rear weight member;

wherein the hardness of the at least one resilient member is varied;

wherein the rear surface of the ball striking face member comprises an engagement member, wherein the engagement member comprises a raised rib element formed as part of the ball striking face member, wherein the raised rib element projects rearward from the rear surface of the ball striking face member, wherein the raised rib element extends from a toe portion of the ball striking face member to a heel portion of the ball striking face member, wherein the at least one rear weight member and varied hardness of the at least one resilient member are configured to receive transferred energy from impact between the face member and a ball, and to selectively limit compressibility of the space between the ball striking face member and the rear weight member and divide the space into: (a) an area of low compressibility located above the raised rib element, and (b) an area of high compressibility located below the raised rib element, wherein the raised rib element is arranged with respect to a center of gravity of the golf club head such that the raised rib element passes through the center of gravity of the iron type golf club head.

2. The iron type golf club head of claim 1, wherein the at least one resilient member is in contact with both the rear surface of the ball striking face member and the front surface of the rear weight member.

3. The iron type golf club head of claim 1, wherein the rear weight member comprises a rear perimeter weight, wherein the rear perimeter weight at least in part defines a rear cavity area.

4. The iron type golf club head of claim 1, wherein the ball striking face member further comprises a hosel integrally formed with ball striking face member.

5. The iron type golf club head of claim 1, wherein the raised rib element comprises a half-cylinder shape, wherein the raised rib element comprises a half circle cross section.

6. The iron type golf club head of claim 5, wherein the at least one resilient member comprises a half-cylinder recess configured to receive the raised rib element.

7. The iron type golf club head of claim 1, wherein the raised rib element comprises a triangular cross sectional shape, wherein a triangular peak of the raised rib element is oriented toward the rear weight member.

8. The iron type golf club head of claim 7, wherein the at least one resilient member comprises a triangular cross sectional recess configured to receive the raised rib element.

9. An iron-type golf club head, comprising:

a ball striking face member including a rear surface and a ball striking face;

a rear weight member including a front surface, at least one resilient member between the front surface of the rear weight member and the rear surface of the ball striking face member, wherein the front surface of the rear weight member and the rear surface of the ball striking face member face one another and define a space therebetween;

wherein the at least one resilient member is disposed within the space, wherein the ball striking face member comprises a first material having a first hardness, wherein the rear weight member comprises a second member having a second hardness, and wherein the at least one resilient member comprises at least a third hardness, wherein no portion of the at least one resilient member comprises a hardness greater than any portion of the ball striking face member or rear weight member;

wherein the hardness of the at least one resilient member is varied;

wherein the rear surface of the ball striking face member comprises an engagement member, wherein the engagement member comprises a raised rib element formed as part of the ball striking face member, wherein the raised rib element projects rearward from the rear surface of the ball striking face member, wherein the raised rib element extends from a toe portion of the ball striking face member to a heel portion of the ball striking face member, wherein the at least one rear weight member and varied hardness of the at least one resilient member are configured to receive transferred energy from impact between the face member and a ball, and to selectively limit compressibility of the space between the ball striking face member and the rear weight member and divide the space into: (a) an area of low compressibility located below the raised rib element, and (b) an area of high compressibility located above the raised rib element, wherein the raised rib element is arranged with respect to a center of gravity of the golf club head such that the raised rib element passes through the center of gravity of the iron type golf club head.

10. The iron type golf club head of claim 9, wherein the at least one resilient member is in contact with both the rear surface of the ball striking face member and the front surface of the rear weight member.

11. The iron type golf club head of claim 9, wherein the rear weight member comprises a rear perimeter weight, wherein the rear perimeter weight at least in part defines a rear cavity area.

12. The iron type golf club head of claim 9, wherein the ball striking face member further comprises a hosel integrally formed with ball striking face member.

13. The iron type golf club head of claim 9, wherein the raised rib element comprises a half-cylinder shape, wherein the raised rib element comprises a half circle cross section.

14. The iron type golf club head of claim 13, wherein the at least one resilient member comprises a half-cylinder recess configured to receive the raised rib element.

15. An iron-type golf club head, comprising:

a ball striking face member including a rear surface and a ball striking face;

a rear weight member including a front surface, at least one resilient member between the front surface of the rear weight member and the rear surface of the ball striking face member, wherein the front surface of the rear weight member and the rear surface of the ball striking face member face one another and define a space therebetween;

wherein the at least one resilient member is disposed within the space, wherein the ball striking face member comprises a first material having a first hardness, wherein the rear weight member comprises a second member having a second hardness, and wherein the at least one resilient member comprises at least a third hardness, wherein no portion of the at least one resilient member comprises a hardness greater than any portion of the ball striking face member or rear weight member;

wherein the hardness of the at least one resilient member is varied;

wherein the front surface of the rear weight member comprises an engagement member, wherein the engagement member comprises a raised rib element formed as part of the rear weight member, wherein the raised rib element projects forward from the front surface of the rear weight member, wherein the raised rib element extends from a toe portion of the rear weight member to a heel portion of the rear weight member, wherein the at least one rear weight member and varied hardness of the at least one resilient member are configured to receive transferred energy from impact between the face member and a ball, and to selectively limit compressibility of the space between the ball striking face member and the rear weight member and divide the space into: (a) an area of low compressibility located above the raised rib element, and (b) an area of high compressibility located below the raised rib element, wherein the raised rib element is arranged with respect to a center of gravity of the golf club head such that the raised rib element passes through the center of gravity of the iron type golf club head.

* * * * *